US005584122A

United States Patent [19]

Kato et al.

[11] Patent Number: 5,584,122

[45] Date of Patent: Dec. 17, 1996

[54] WATERPROOF CONNECTION METHOD FOR COVERED WIRE WITH RESIN ENCAPSULATION

[75] Inventors: Sanae Kato, Gotenba; Nobuyuki Asakura, Shizuoka-ken; Keiichi Ozaki, Kosai; Mineo Takahashi, Shizuoka-ken, all of Japan

[73] Assignee: Yazaki Corporation, Tokyo, Japan

[21] Appl. No.: 414,204

[22] Filed: Mar. 31, 1995

[30] Foreign Application Priority Data

| | | | |
|---|---|---|---|
| Apr. 1, 1994 | [JP] | Japan | 6-065284 |
| Oct. 25, 1994 | [JP] | Japan | 6-260561 |
| Oct. 25, 1994 | [JP] | Japan | 6-260564 |

[51] Int. Cl.[6] ..... H01R 43/00

[52] U.S. Cl. ..... 29/872; 29/868; 174/84 R

[58] Field of Search ..... 29/872, 859, 868; 174/84 R, 87; 156/53, 49

[56] References Cited

U.S. PATENT DOCUMENTS

| | | | |
|---|---|---|---|
| 2,250,156 | 7/1941 | Ferguson | 29/859 X |
| 3,418,444 | 12/1968 | Ruehlemann | 174/84 R X |
| 4,878,969 | 11/1989 | Janisch | 174/84 R X |

FOREIGN PATENT DOCUMENTS

| | | | |
|---|---|---|---|
| 0045080 | 4/1977 | Japan | 29/872 |
| 60-37814 | 11/1985 | Japan . | |
| 2-106092 | 4/1990 | Japan . | |
| 3-1462 | 1/1991 | Japan . | |
| 4-61777 | 2/1992 | Japan . | |

*Primary Examiner*—Larry I. Schwartz
*Assistant Examiner*—Khan V. Nguyen
*Attorney, Agent, or Firm*—Oblon, Spivak, McClelland, Maier & Neustadt, P.C.

[57] ABSTRACT

In the covered-wire connection method and structure in which at least one of members to be conductively connected to each other is a covered wire comprising a conductive wire portion and a cover portion of resin which is coated around the outer periphery of the conductive wire portion, both of the members are overlapped with each other at connection portions thereof, the overlapped connection portions are pinched between a pair of resin chips, and then the cover portion are melted and dispersed by ultrasonic vibration while pressing the connection portions of the members from the outside of the resin chips to conductively connect both of the members to each other at the connection portions thereof. Thereafter, the pair of the resin chips are melted to be fixed to each other, so that the connection portions are sealed with the melted resin chips.

7 Claims, 26 Drawing Sheets

FIG. 7

| | MELT-FIXING HEIGHT mm | | | | | | | |
|---|---|---|---|---|---|---|---|---|
| | 2.9 | 3.1 | 3.3 | 3.4 | 3.5 | 3.6 | 3.7 | 3.8 |
| FIXING FORCE kgf | 12.21 | 12.95 | 11.44 | · 12.84 | · 12.74 | · 10.99 | · 12.89 | · 11.91 |
| | 12.05 | 12.48 | 12.21 | · 13.2 | · 12.93 | · 10.81 | · 11.2 | · 12.64 |
| | · 12.06 | 12.05 | 13.04 | · 13.48 | · 13.03 | · 13.00 | · 11.73 | · 11.98 |
| | · 12.7 | 12.85 | 12.91 | 12.43 | 13.38 | · 12.54 | · 11.8 | · 12.03 |
| | 12.15 | · 10.9 | · 13.03 | 13.15 | · 12.94 | 13.2 | · 12.01 | 12.56 |
| | 11.76 | 13.24 | 12.78 | 12.95 | · 13.44 | · 13.06 | · 12.53 | · 12.25 |
| | 12.44 | 12.81 | 12.95 | 13.1 | · 12.18 | 12.58 | · 12.2 | · 11.95 |
| | · 13.13 | 12.68 | 12.23 | · 12.26 | 12.28 | 12.2 | · 12.29 | · 11.3 |
| | 12.6 | 12.89 | 12.63 | · 12.98 | 12.39 | · 12.61 | · 11.78 | · 10.69 |
| | 12.98 | 11.64 | · 12.3 | · 12.73 | · 11.91 | 12.81 | · 11.35 | · 11.33 |
| AVERAGE | 12.408 | 12.449 | 12.552 | 12.912 | 12.722 | 12.38 | 11.978 | 11.864 |
| STANDARD DEVIATION | 0.4179187 | 0.6804183 | 0.4829037 | 0.3463178 | 0.4891993 | 0.7906959 | 0.4915445 | 0.5716327 |

WATERPROOF CONNECTION METHOD FOR COVERED WIRE WITH RESIN ENCAPSULATION

BACKGROUND OF THE INVENTION

1. Field of the Invention

This invention relates to a connection method for conductively connecting a covered wire (conductor) to another member, and a connection structure of a covered wire.

2. Description of Related Art

Various connection modes such as a connection between a covered wire W and a terminal, a connection between at least two covered wires W, a connection between a covered wire W and a connector, etc have been hitherto utilized to conductively connect a covered wire to another member have been hitherto utilized.

With respect to the connection mode for connecting the covered wire to the terminal, a press-fitting manner, a press-contacting manner (see Japanese Examined Utility Model Application No. 60-37814), a soldering manner, an ultrasonic welding manner (see Japanese Laid-open Patent Application No. 2-106092), and other connection manners have been hitherto known.

The press-fitting connection is performed as follows. A cover portion at a connection portion of a covered wire is removed from the covered wire to expose a conductive wire portion at the connection portion. Thereafter, the exposed conductive wire portion of the covered wire is placed on a connection portion of a terminal fitting (terminal), and then the conductive wire portion is press-fitted to the terminal fitting by crimping the conductive wire portions through a pair of conductor crimping pieces 13 which are erectly formed at both sides of the terminal fitting so as to confront each other at the connection portion, thereby conductively connecting the covered wire to the terminal fitting. The terminal fitting is further provided with cover crimping pieces to improve a mechanical connection strength, and the conductive wire portion and the cover portion are press-fitted to the terminal fitting by the conductor crimping pieces and the cover crimping pieces.

The press-contacting connection is performed as follows. A connection portion of a covered wire is pressed into a slot of a press-contacting blade which is provided to a connection portion of a press-contacting terminal so that the cover portion of the covered wire is peeled off by the press-contacting blade, thereby conductively contacting the press-contacting blade to the conductive wire portion.

The connection using the soldering manner or the ultrasonic welding manner is performed as follows. A cover portion of a connection portion at one end portion of the covered wire is removed to exposed a conductive wire portion, and then the exposed conductive wire portion is welded to a connection portion of a terminal fitting by soldering or ultrasonic welding, thereby conductively connecting the covered wire to the terminal fitting. With respect to the connection mode for connecting two or more covered wires to one another, a connection manner using a joint terminal, a thermal press-fitting connection manner (Japanese Laid-open Patent Application No. 3-1462), etc. have been hitherto known.

The joint-terminal connection is performed as follows. Cover portions of both covered wires are removed at a connection portion thereof to expose conductive wire portions of the covered wires. These covered wires are placed so that the conductive wire portions thereof are overlapped with each other, and these conductive wire portions are crimped through a joint terminal and press-fitted to each other to conductively connect these conductive wire portions of the covered wires.

The thermal press-fitting connection is performed as follows. The cover portions of both covered wires are removed at a connection portion thereof to expose conductive wire portions of the covered wires. The exposed conductive wire portions are overlapped with each other and placed between electrodes. The overlapped conductive wire portions are supplied with current through the electrodes under pressure to heat the overlapped conductive wire portions, so that the conductive wire portions are thermally press-fitted to each other and conductively connected to each other. In addition to the above heating manner for the conductive wire portions has been known a heating manner of heating the conductive wire portions with frictional heat which is caused by ultrasonic vibration.

When the joint-terminal connection and the thermal press-fitting connection as described above are performed, an insulation material such as a tape or the like is wound around the outer periphery of the connection portion to ensure insulation of the covered wires at the connection portion.

With respect to the connection mode for connecting a covered wire to a connector, a connection manner using ultrasonic welding is known (Japanese Laid-open Patent Application No. 4-61777).In the ultrasonic-welding connection, a connector comprising a lower mold and an upper mold is used. The lower mold has a groove portion and the upper mold has a projection which is engagedly insertable into the groove portion. A connection portion of a covered wire is placed on a connection portion of a conductive connection member, and then the upper mold is placed on the lower mold so that the projection of the upper mold is engagedly inserted into the groove portion of the lower mold. Thereafter, ultrasonic vibration is applied to the engaged upper and lower molds from the external to melt the cover portion of the covered wire at the connection portion, thereby conductively connecting the conductive wire portion to the conductive connection member.

The conventional connection modes as described above have the following disadvantages.

In the case where the connection between the covered wire and the terminal is performed using the press-fitting, the soldering or the ultrasonic welding, the cover portion of the covered wire is required to be removed in advance to expose the conductive wire portion at the connection portion, so that a connection work is cumbersome. On the other hand, in the case where the connection is performed using the pressure-contacting manner, the cover portion is not required to be removed, however, it is unavoidable to reduce the mechanical strength of the connection portion as compared with the press-fitting or soldering connection. Therefore, simplification of the connection work is incompatible with improvement of the mechanical strength. In the case where the connection between two covered wires is performed using the joint terminal or the thermal press-fitting, the cover portion is required to be removed like the above case, and thus the connection work is cumbersome. Furthermore, in order to facilitate the crimping work of the joint terminal and the thermal press-fitting work, it is required to remove the cover portion in a relatively broad range. Furthermore, the insulation material must be wound at the connection portion in a broader range than the removal range of the cover portion, and thus the winding range of the insulation material is relatively larger than the connection portion between the conductive wire portions of the covered wires. Therefore, flexibility of the covered wire may be deteriorated, and thus the degree of freedom of wire arrangement may be reduced. Furthermore, the thermal press-fitting connection reduces the mechanical strength of the connection portion more than the joint terminal connection.

In the case where the connection between the covered wire and the connector is performed using the ultrasonic welding, a connector having such a special shape that a groove portion and a projection are formed in a lower mold and an upper mold respectively is required, and thus this connection is not applicable to all connectors. In addition, this connection mode is not easily applicable to the connection between the covered wire and the terminal and the connection between the covered wires. That is, this connection mode is unsuitable for wide use.

In addition to the various connection modes, a connection mode for connecting a multipolar connector to plural connectors through plural covered wires has been also utilized as a special case of the connection mode for conductively connecting the covered wire and the connector. In this connection mode, in some cases the multipolar connector are equipped with some portions which functionally require a waterproof property (hereinafter referred to as "waterproof-required portions"). In this case, these portions are subjected to a waterproof treatment. On the other hand, each covered wire has various gaps therein, for example, a gap between core wires (a gap formed in the conductive wire portion) and a gap between a bundle of the core wires and a cover portion surrounding the core wires, and water or the like may flow through these gaps due to the capillary phenomenon. Accordingly, when a waterproof multipolar connector is connected to plural individual connectors through a plurality of covered wires as described above, water which invades from the connectors into the covered wires may flow through the gaps formed in the covered wires into the multipolar connector. Therefore, the multipolar connector cannot be kept in a sufficient waterproof state even if it is subjected to the waterproof treatment.

As a method of avoiding the above disadvantage, the individual connectors which are connected to the multipolar connector may be subjected to the waterproof treatment in advance. According to this method, no water flows into the covered wires, and thus the sufficient waterproof property can be kept for the waterproof-required portions of the multipolar connector. However, This method needs all the individual connectors to be subjected to the waterproof treatment even when no waterproof treatment is required for some connectors, so that all the individual connectors must be designed in complicated waterproof structure and the cost may rise up due to a cumbersome fabrication work.

SUMMARY OF THE INVENTION

An object of the present invention is to provide a covered wire connection method and a connection structure of a covered wire in which the simplification of a connection work and the improvement of the mechanical strength of a connection portion of a covered wire are compatible with each other.

Another object of the present invention is to provide a covered wire connection method and a connection structure of a covered wire in which sufficient insulation is kept for a connection portion of the covered wire by reducing an area required for the connection.

Another object of the present invention is to provide a covered wire connection method and a connection structure of a covered wire which is easily and widely usable for various connection modes such as a connection between a covered wire and a terminal, a connection between covered wires, etc.

The other object of the present invention is to provide a covered wire connection method and a connection structure of a covered wire in which a sufficient waterproof property can be kept for a covered wire, particularly for a covered wire having one end side needing a waterproof property and the other end sid which needs no waterproof property, with a simple work and in a simple structure.

According to a first aspect of the present invention, a covered wire connection method in which at least one of members to be conductively connected to each other is a covered wire comprising a conductive wire portion and a cover portion of resin which is coated around the outer periphery of the conductive wire portion, comprises a first step of overlapping both of the members with each other at connection portions thereof and pinching the overlapped connection portions between a pair of resin chips, and a second step of melting and dispersing the cover portion and applying pressure to the connection portions of the members from the outside of the resin chips to conductively connect both of the members to each other at the connection portions thereof, and thereafter melting the pair of the resin chips so as to be fixed to each other (hereinafter referred to as "melt-fixing"), whereby the connection portions are sealed with the melted resin chips.

In the covered wire connection method of the first aspect of the present invention, in the second step the melted resin chip may be filled into gaps between neighboring core wires of the conductive wire portion in an area excluding the connection portions so that the covered wire has a waterproof property.

In the covered wire connection method of the first aspect of the present invention, in the first step the connection portions of the members are pinched between the resin chips, and at least one of the resin chips may be provided with brazing material. In the second step the brazing material is melted by heat induced when the resin chips are melted, and the conductively-contacted connection portions are fixed to each other through the melted brazing material.

The brazing material as described above may be provided so as to be placed on or buried in at least one of the resin chips.

In the covered wire connection method of the first aspect of the present invention, in the second step both of the members are pinched between the pair of resin chips from the upper and lower sides in an overlapping direction of the members, and the connection portions of the members are placed between a horn (acoustic horn) and an anvil, and excited under press (pressure) from the outside of the resin chips. The excitation (vibration) direction and the press direction may be set to be coincident with the overlapping direction of the members.

In the covered-wire connection method of the first aspect of the present invention, in the second step both of the members are pinched by the pair of resin chips from the upper and lower sides in an overlapping direction of the members, and the connection portions of the members are placed between a horn (acoustic horn) and an anvil, and excited under press from the outside of the resin chips. The press direction may be set to be coincident with the overlapping direction of the members, and the excitation (vibration) may contain a longitudinal vibration component whose direction is coincident with the overlapping direction and a lateral vibration component whose direction is perpendicular to the overlapping direction.

According to a second aspect of the present invention, a covered-wire connection structure in which at least one of members to be conductively connected to each other is a covered wire comprising a conductive wire portion and a cover portion of resin which is coated around the outer periphery of the conductive wire portion, is characterized in that the cover portion of the covered wire at a connection portion is removed from the covered wire to expose the conductive wire portion of the covered wire at the connection portion and conductively connect both of the members to each other, and the connection portions of the members are sealed with resin material.

In the covered-wire connection structure of the second aspect of the present invention, the resin material may be filled into gaps between neighboring core wires of the conductive wire portion in an area excluding the connection portion so that the covered wire has a waterproof property.

In the covered-wire connection structure of the second aspect of the present invention, both of the members may be fixed to each other at the connection portions with brazing material. In the covered-wired connection structure of the second aspect of the present invention, the resin material may be transparent material.

In the covered-wire connection structure of the second aspect of the present invention, the covered wire may be a flat cable comprising a sheet-shaped resin cover portion and plural conductive wire portions which are juxtaposed in the sheet-shaped resin cover portion.

According to a third aspect of the present invention, a waterproof connection method for a covered wire which comprises plural core wires constituting a conductive wire portion and a cover portion which is formed of resin and coated around the outer periphery of the conductive wire portion, comprises a first step of pinching the covered wire between a pair of resin chips, and a second step of melting and dispersing the cover portion of the covered wire pinched by the resin chips to melt-fix the pair of resin chips, and filling the melted resin chips into gaps between the wire cores.

In the covered-wire waterproof connection method of the third aspect of the present invention, in the second step the covered wire are pinched by the pair of resin chips from the upper and lower sides of the covered wire, and then excited under press between a horn and an anvil from the outside of the resin chips. The press and excitation direction are set to be coincident with the vertical direction.

According to a fourth aspect of the present invention, a waterproof connection structure of a covered wire which comprises plural core wires (conductive wire portion) and a cover portion of resin which is coated around the outer periphery of the conductive wire portion is characterized in that the conductive wire portion of the covered wire is exposed and resin material is filled into gaps between the wire cores of the exposed conductive wire portion to seal the exposed conductive wire portion with the resin material.

In the waterproof connection structure as described above, the resin material may be transparent material.

In the waterproof connection structure of the fourth aspect of the present invention, the covered wire may be a flat cable comprising a sheet-shaped resin cover portion and plural conductive wire portions which are juxtaposed in the cover portion.

According to the first aspect of the present invention, both of the members are overlapped with each other at the connection portions thereof, and the overlapped connection portions of the members are pinched by a pair of resin chips. The cover portions of the overlapped connection portions of the members are melted and dispersed while pinched by the pair of resin chips, and pressure is applied to the resin chips from the outside thereof, whereby the members are conductively connected to each other at the connection portions thereof. Therefore, it is not required to remove the cover portions of the members in advance, and thus both members can be conductively connected to each other with a simple connection work.

In addition, since after the members are conductively connected to each other at the connection portions thereof, the connection portions are sealed by melt-fixing the pair of resin chips, a high mechanical strength can be obtained at the connection portions by the melted and hardened resin chips.

Furthermore, the pair of resin chips are designed in such a shape as to pinch the connection portions of the members to be conductively connected to each other from the upper and lower sides of the connection portions, and the connection portions are sealed by the resin chips, so that the sufficient insulation can be kept for the connection portions.

The connection method as described above is a relatively simple method in which the overlapped portions are pinched by the pair of resin chips, the cover portions are melted and the pressure is applied from the outside, and thus no restriction in shape, etc. is imposed on the other member to be conductively connected to the covered wire. Therefore, this connection method is easily applicable to various connection modes such as a connection between a covered wire and a terminal, a connection between to covered wires, etc., and thus it can be widely used.

According to the connection method of the first aspect of the present invention, since in the second step the melted resin chip is filled into the gaps between the neighboring core wires of the conductive wire portion at the portions other than the connection portions, the gaps between the core wires of the covered wire are shielded by the hardened resin chip, so that the waterproof effect can be obtained in the covered wire.

According to the connection method of the first aspect of the present invention, the resin chips at least one of which is provided with the brazing material are used, and the brazing material is melted by the heat induced due to the melting of the resin chips to fix the members at the conductively-contacted connection portions with the brazing material. Therefore, no special brazing work is required, and a higher mechanical strength can be obtained at the connection portion with a simple work.

According to the connection method of the first aspect of the present invention, the brazing material is buried in at least one of the resin chips, so that the brazing material is melted out in the resin chip after the cover portions are dispersively melted to conductively contact both members with each other and the connection portions are covered with the resin chips. Accordingly, the conductively-contacted connection portions can be surely fixed to each other with the brazing material, and the brazing material can be surely prevented from flowing out from the resin chips.

According to the first aspect of the present invention, both of the members are pinched by the pair of resin chips from the upper and lower sides in the overlapping direction of the members, and the connection portions of the members are pressed and vibrated between the horn and the anvil from the outside of the resin chips to melt the resin chips and the cover portion, whereby the members are conductively contacted with each other at the connection portions and the resin chips are melt-fixed to each other. Therefore, the same effect as the connection method of any one of the first aspect and the first to third modifications thereof.

Furthermore, since the press direction is set to be coincident with the overlapping direction of the members, the melted cover portion is extruded from the center side of the resin chips to the external side thereof by pressing the connection portions through the resin chips. Therefore, the conductive wire portion is exposed more excellently, and the members can be surely kept in an excellent conductive contact state.

Still furthermore, since the excitation direction of the connection portions is set to be coincident with the overlapping direction of the members like the press direction, the resin chips can be set in an excellent melt-fixing state, and the action of extruding the melted cover portion from the center side of the resin chips to the external side thereof can be promoted.

According to the first aspect of the present invention, the connection portions of the members are pinched by the pair of resin chips from the upper and lower sides in the overlapping direction of the members, and excited under press between the horn and the anvil from the outside of the resin chips to melt the resin chips and the cover portion of the covered wire, so that the both members are conductively contacted with each other at the connection portions thereof and the resin chips are melt-fixed to each other. Therefore, the same effect as the first aspect and the first to third modifications as described above can be obtained with a simple method.

Furthermore, since the press direction is set to be coincident with the overlapping direction of the both members, the melted cover portion is extruded from the center side of the resin chips to the external side thereof when the connection portions are pressed, so that the conductive wire portion is exposed more excellently and the conductive contact state can be surely obtained.

Still furthermore, the excitation of the connection portions is set to have a vibration component in the overlapping direction and a vibration component in a direction perpendicular to the overlapping direction. Therefore, by the vibration component in the overlapping direction, the excellent melt-fixing state of the resin chips can be obtained and the action of extruding the melted cover portion from the center side of the resin chips to the external side thereof can be promoted. In addition, the metallic connection between the both members at the connection portions thereof is enlarged by the vibration component in the direction perpendicular to the overlapping direction.

According to the connection structure of the second aspect of the present invention, the conductive wire portion of the covered wire at the connection portion at which both members are overlapped with each other is exposed from the covered wire to conductively contact both members with each other, and the connection portions of both of the members are sealed with the resin material. Therefore, the high mechanical strength can be obtained at the connection portion with the hardened resin material.

Furthermore, the resin material may be designed in such a small size as to seal the conductively-contacted connection portions of the covered wires. Therefore, an area required for the connection can be reduced to a small one. In addition, the connection portions are sealed by the resin material, so that the sufficient insulation can be kept.

In the connection structure as described above, no restriction in shape, etc. is imposed on the other member to be conductively connected to the covered wire. Accordingly, this structure is applicable to various connections such as a connector between a covered wire and a terminal, a connection between covered wires, etc., and thus it can be widely used.

According to the second aspect of the present invention, the resin material is filled into the gaps between the neighboring core wires of the conductive wire portion except for the connection portion, and thus the gaps between the core wires of the covered wire are shielded by the resin material, so that the waterproof (water stopping) effect can be obtained in the covered wire.

According to the second aspect of the present invention, since the connection portion is brazed with the brazing material, higher electric performance can be obtained.

According to the second aspect off the present invention, since the resin material is transparent material, the conductive contact state of the conductive wire portion and the brazing state can be viewed from the outside of the resin material.

According to the second aspect of the present invention, the same effect as one of the second aspect and the first to third modifications thereof can be obtained even when the flat cable having plural conductive wire portions juxtaposed in the sheet-shaped resin cover portion is conductively connected to another member, and thus this modification can be more widely used.

According to the covered-wire waterproof connection method of the third aspect of the present invention, the cover portion is dispersively melted to expose the conductive wire portion thereof while pinched by the pair of resin chips, and then the resin chips are melt so that the resin chips are fixed to each other and the melted resin chips are filled into the gaps between the core wires of the exposed conductive wire portion. With this method, the exposed conductive wire portion is sealed with the resin chips, and the gaps formed between the core wires of the conductive wire portion are shielded by the hardened resin chips. Therefore, the waterproof (water stopping) effect can be obtained for the covered wire at both sides of the resin chips.

Furthermore, the pair of resin chips may be designed in such compact shape and size as to pinch the covered wire from the upper and lower sides of the covered wire, so that an area required for the waterproof treatment of the covered wire can be reduced to a small one.

Still furthermore, this method is a relatively simple method in which the covered wire is pinched by a pair of resin chips and then the resin chips are melt-fixed to each other, and no restriction is imposed on the shape, etc. of the covered wire. Therefore, this method is easily applicable to covered wires having various shapes, and thus it can be more widely used.

According to the third aspect of the present invention, the covered wire is pinched by the pair of resin chips from the upper and lower sides of the covered wire, and then excited and pressed from the outside of the resin chips between the horn and the anvil to melt the resin chips and the cover portion, so that the resin chips are melt-fixed to each other and the melted resin chips are filled into the gaps between the core wires, so that the same effect as the third aspect can be obtained with a simple method.

Furthermore, the press direction is coincident with the vertical direction, so that the melted cover portion is extruded from the center side of the resin chips to the external side thereof and the conductive wire portion is excellently exposed in the resin chips.

Still furthermore, the excitation direction is also coincident with the vertical direction like the press direction, so that the resin chips can be set to an excellently melt-fixing state, and the action of extruding the melted cover portion from the center side of the resin chips to the external side thereof is promoted.

According to the fourth aspect of the present invention, the conductive wire portion of the covered wire is exposed and the resin material is filled into the gaps between the core wires to seal the exposed conductive wire portion with the resin material. Therefore, the gaps between the core wires of the covered wire are kept to be shielded by the resin material, so that the waterproof (water stopping) effect can be obtained in the covered wire at both sides of the resin material.

Furthermore, the resin material may be designed in such compact shape and size as to seal the covered wire, so that an area required for the waterproof treatment of the covered wire can be reduced to a small one.

Still furthermore, the waterproof connection structure of the covered wire does not restrict the shape, etc. of the covered wire to special ones, so that this waterproof connection structure is applicable to covered wires having various shapes, and it is more widely usable.

According to the fourth aspect of the present invention, since the resin material is the transparent material, the filling state of the resin material can be viewed from the outside.

According to the fourth aspect of the present invention, the same effects as described above can be obtained even for a flat cable including plural conductive wire portions which are juxtaposed in a sheet-shaped cover portion of resin, and thus it is more widely usable.

BRIEF DESCRIPTION OF THE DRAWINGS

FIGS. 3A and 3B are cross-sectional views of the connection system of FIG. 1 which are viewed along an arrow A, wherein FIG. 3A shows a state just after the connection is started, and FIG. 3B shows a state after the connection is performed;

FIGS. 4A and 4B are perspective views of a covered wire connection structure of the first embodiment, wherein FIG. 4A shows the external appearance, and FIG. 4B shows the internal structure;

FIGS. 5A and 5B are diagrams showing an impact test, wherein FIG. 5A shows a tap test and FIG. 5B shows a shaking test;

FIG. 7 is a table showing a test result of fixing force for each melt-fixing height of acrylic resin;

FIGS. 9A and 9B are cross-sectional views of a connection structure of a second embodiment, which are taken along lines P—P and Q—Q of FIG. 3 respectively, wherein FIG. 9A shows a state before the connection and FIG. 9B shows a state after the connection;

FIGS. 13A and 13B are cross-sectional views of FIG. 12, wherein FIG. 13A shows a state just before the connection is started, and FIG. 13B shows a state after the connection;

FIGS. 16A and 16B are cross-sectional views showing a covered wire connection method of the fifth embodiment, wherein FIG. 16A shows a state at a half time during a connection process, and FIG. 16B shows a state at the other half time during the connection process;

FIGS. 27A and 27B are cross-sectional views of the waterproof connection system of FIG. 25 which are viewed along an arrow A, wherein FIG. 27A shows a state at the time when the waterproof treatment is started, and FIG. 27B shows a state after the waterproof treatment is started;

DETAILED DESCRIPTION OF THE PREFERRED EMBODIMENTS

Preferred embodiments according to the present invention will be described hereunder with reference to the accompanying drawings.

A first embodiment according to the present invention will be described.

Figure 1:
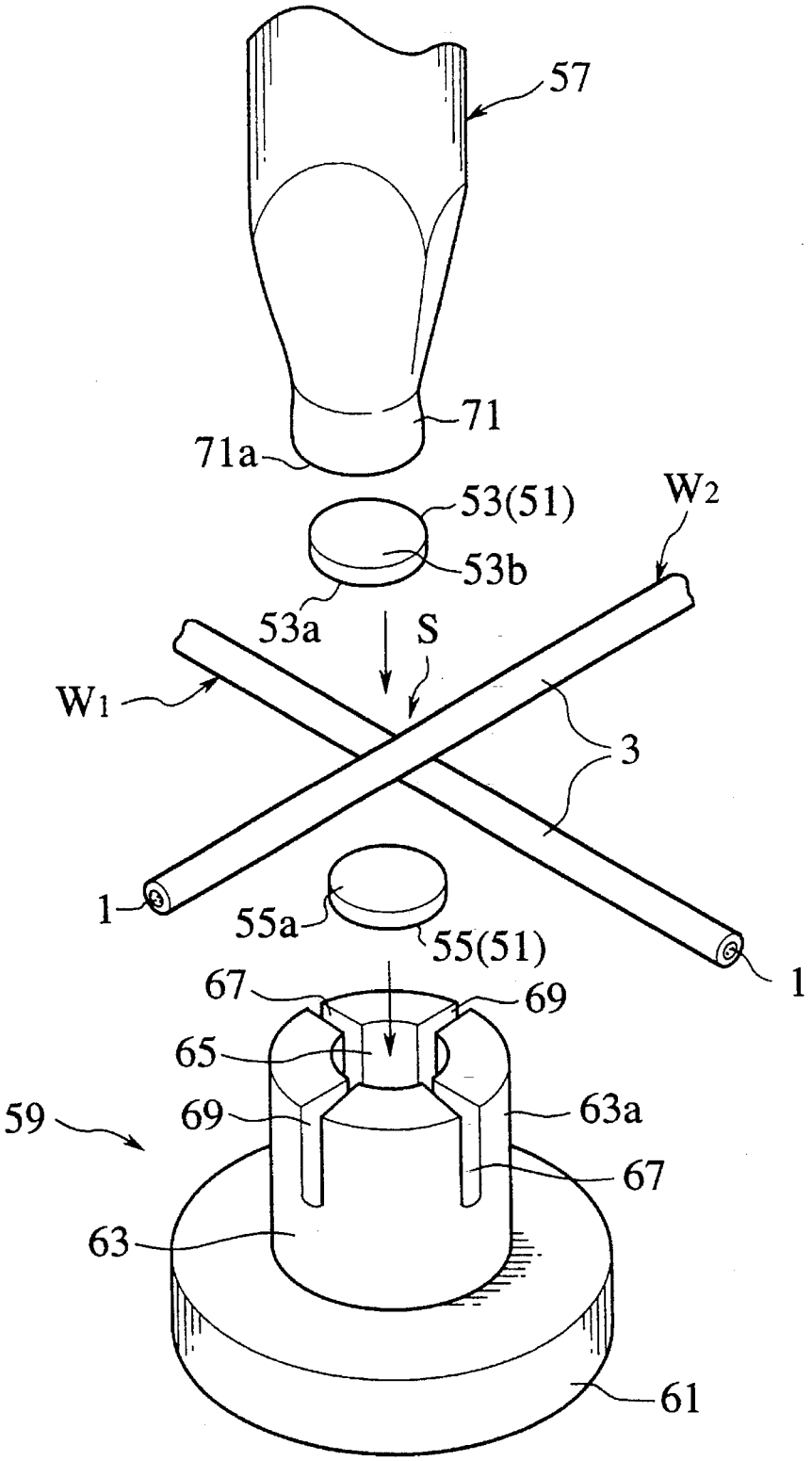
FIG. 1 is a perspective view showing a connection system for obtaining a covered-wire connection structure of a first embodiment before the connection is performed.
Figure 2:
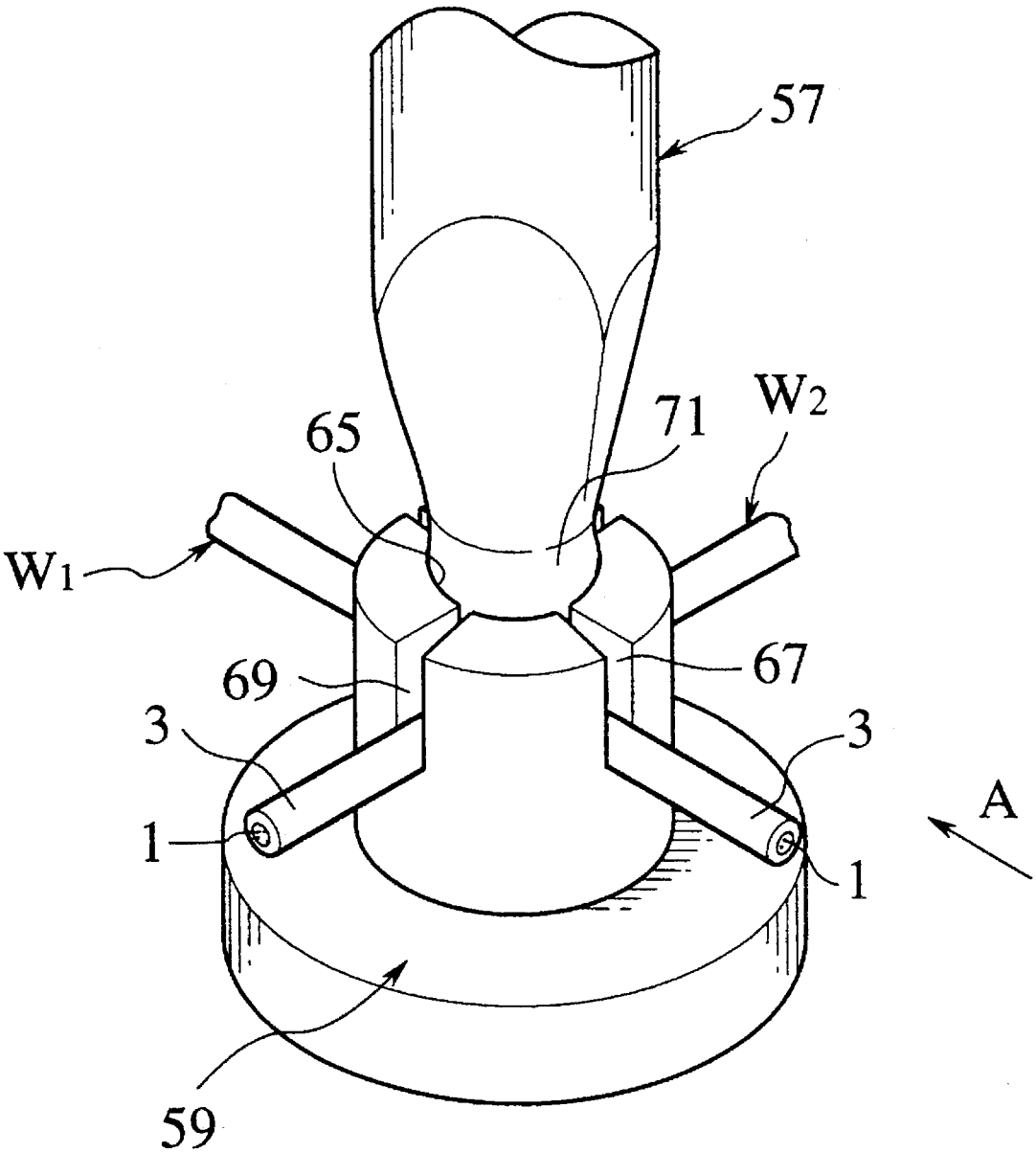
FIG. 2 is a perspective view showing the connection system shown in FIG. 1 after the connection is performed.
Figure 3A:
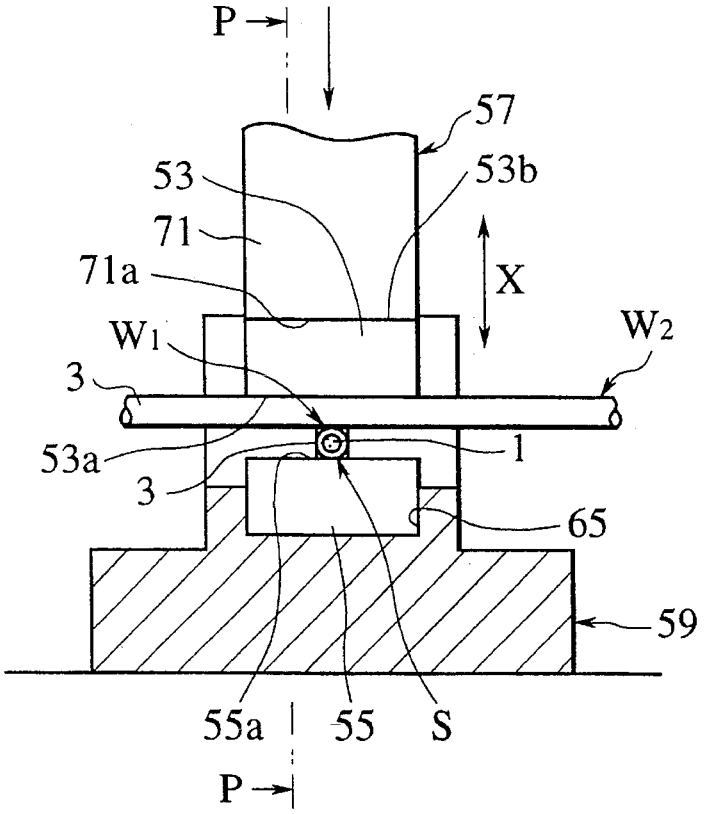
Figure 3B:
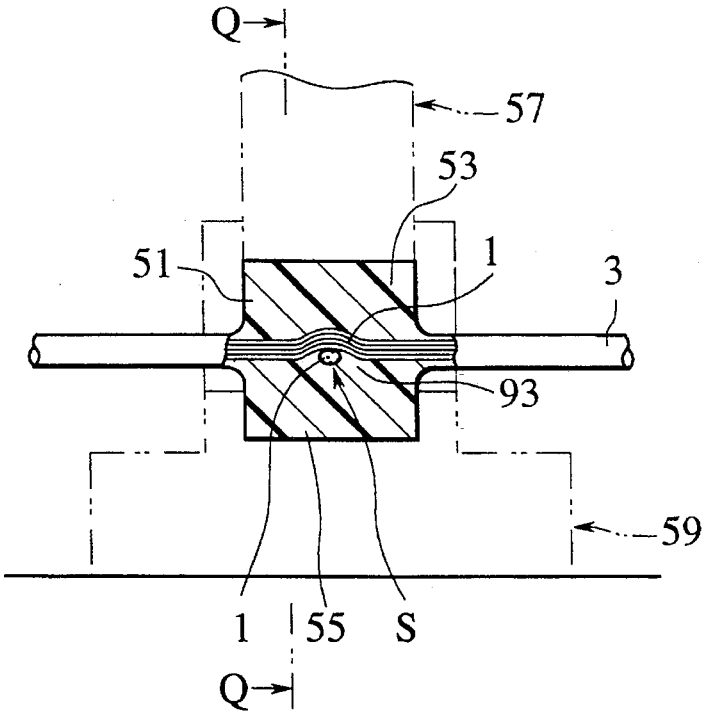

FIGS. 1 and 2 are schematic diagrams showing a connection system for obtaining a connection structure of a covered wire according to the first embodiment when two covered wires W1 and W2 are required to be connected to each other. Particularly, FIG. 1 shows a state of the system before the covered wires are connected to each other, and FIG. 2 shows a state of the system after the covered wires are connected to each other. FIGS. 3A and 3B are cross-sectional views of the connection system shown in FIGS. 1 and 2 which are viewed from an arrow A, respectively. Particularly, FIG. 3A shows the connection state before the covered wires are connected to each other, and FIG. 3B shows the connection state after the covered wires are connected to each other.

In the first embodiment, the two covered wires W1 and W2 each of which comprises a conductive wire portion 1 and a cover portion 3 which is formed of resin and coated around the outer periphery of the conductive wire portion, are conductively connected to each other at connection portions S thereof as shown in FIG. 1.

First, a connection method for the covered wires W1 and W2 according to the first embodiment will be described.

For the connection of the two covered wires W1 and W2 are used a pair of resin chips 53 and 55 serving as a resin material 51, a horn 57 for producing ultrasonic vibration, which is an ultrasonic welding apparatus, and an anvil 59 for supporting the covered wires W1 and W2 and the resin chips 53 and 55 when the connection between the covered wires is performed. The anvil 59 includes a base stand 61 and a support portion 63 projecting from the base stand 61. The support portion 63 is designed in a substantially cylindrical shape. The support portion 63 has a bore portion 65 which is opened at the opposite side to the base stand side (at the upper side in FIG. 1), and two pairs of grooves are formed on the peripheral wall of the support portion 63 so as to cross with each other substantially at the center of the bore portion 65, that is, the four grooves are formed on the peripheral wall of the support portion 63 at substantially 90° interval (each pair of two grooves are aligned straightly so as to confront each other with respect to the center of the bore portion, and the respective pairs of grooves cross each other at the center of the bore portion 65). The four groove portions 67 and 69 are formed on the peripheral wall of the support portion 63 so as to be opened at the same side as the bore portion 65, extend along the projection direction of the support portion 63 and intercommunicate with one another through the bore portion 65. The pair of resin chips 53 and 55 are designed in a disc shape having a slightly smaller outer diameter than the diameter of the bore portion 65 of the anvil 59. Furthermore, the end face 71*a* of a head portion 71 of the horn 57 is designed in a disc shape having an outer diameter which is substantially equal to or slightly smaller than that of the resin chips 53 and 55. As material of the resin chips 53 and 55 may be used acrylic resin, ABS (acrylonitrile-butadiene-styrene copolymer) resin, PC (polycarbonate) resin, PVC (polyvinyl chloride) resin, PE (polyethylene) resin or the like.

In order to connect the two covered wires W1 and W2 to each other, both of the covered wires W1 and W2 are overlapped with each other at the connection portions S thereof, and the overlapped connection portions S are pinched by the pair of resin chips 53 and 55 from the upper and lower sides of the connection portions S. Specifically, one of the resin chips (the resin chip 55 at the lower side) is inserted into the bore portion 65 of the anvil 59, and then one of the covered wires (the covered wire W1) is inserted into the pair of confronting grooves 67 from the upper side of the inserted resin chip 55, so that the covered wire W1 is placed on the inserted resin chip 55 in the bore portion 65. Thereafter, the other covered wire W2 is inserted into the other pair of confronting grooves 69 from the upper side of the inserted covered wire W1. Finally, the other resin chip 53 is inserted into the bore portion 65 and placed on the covered wire W2. The covered wires W1 and W2 are arranged in the bore portion 65 so that the respective connection portions S thereof cross each other at the center of the bore portion 65. Through this arrangement, the connection portions S of the covered wires are pinched substantially at the center of the resin chips 53 and 55 from the upper and lower sides of the covered wires W1 and W2 in the overlapping direction by the upper and lower resin chips 53 and 55.

Subsequently, the cover portions 3 at the connection portions S of the covered wires are melted so as to be dispersed and the conductive wire portions 1 of the covered wires W1 and W2 are conductively contacted with each other at the connection portions S thereof by pressing the covered wires from the outside of the resin chips 53 and 55. Thereafter, the pair of the resin chips are mutually melt-fixed to each other to seal the connection portions S.

Specifically, the head portion 71 of the horn 57 is inserted into the bore portion 65 from the upper side of the finally-inserted upper resin chip 53 and placed on the upper resin chip 53 to excite and press the connection portions S of the covered wires from the outside of the upper and lower resin chips 53 and 55 between the horn 57 and the anvil 59. The press of the connection portions S is performed by pressing the horn 57 toward the anvil, and the press direction is coincident with the overlapping direction of the covered wires.

When the resin materials 51 are melt-fixed to each other by the ultrasonic vibration, the excitation is preferably performed in a direction which substantially perpendicularly intersects to the connection surface of the resin materials 51 because it provides the most excellent melt-fixing state. Therefore, the direction of the excitation of the connection portions S is set to a direction which crosses the confronting surfaces 53*a* and 55*a* of the resin chips 53 and 55, that is, it is set to be coincident with the overlapping direction of the covered wires W1 and W2 (as indicated by an arrow X in FIG. 3A). With this arrangement, longitudinal vibration is produced from the horn 57.

When the connection portions S are pressed and excited in the above state, the cover portions 3 are first melted and the conductive wire portions 1 of the covered wires W1 and W2 are exposed at the connection portions S between the resin chips 53 and 55. At this time, the melted cover portions 3 are extruded from the center side of the resin chips 58, 55 toward the outside thereof because the connection portions S are pressed from the upper and lower sides, so that the conductive wire portions 1 are more excellently exposed and surely conductively contacted with each other. Like the press direction, the direction of the excitation of the connection portions S is set to be coincident with the overlapping direction of the covered wires W1 and W2, so that the action of extruding the melted cover portions 3 from the center side of the resin chips 53, 55 to the outside thereof is promoted.

When the pressing and exciting operation on the connection portions S is further continued after the melting of the cover portions 3, the resin chips 53 and 55 are melted, and the confronting surfaces of the resin chips 53 and 55 (the lower surface of the upper resin chip 53 and the upper surface 55*a* of the lower resin chip 55) are melt-fixed to each other. In addition, the outer peripheral surface portions of the cover portions 3 which are adjacent to the conductively-contacted conductive wire portions 1 and the resin chips 53 and 55 are melt-fixed. With this operation, the outer periphery portions of the conductively-contacted conductive wire portions 1 are kept to be coated with the resin chips 53 and 55.

After the melting of the resin chips 53 and 55, the pressing and exciting operation of the horn 57 is stopped to harden the melted cover portions 3 and the melted resin chips 53 and 55, and the connection work is finished.

Figure 4A:
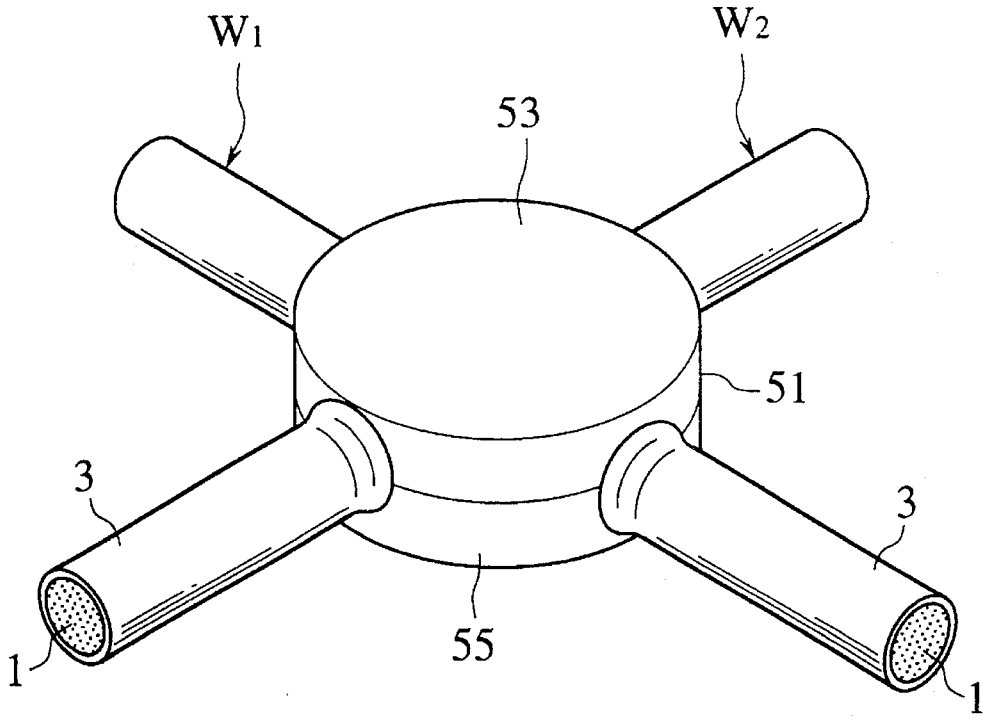
Figure 4B:
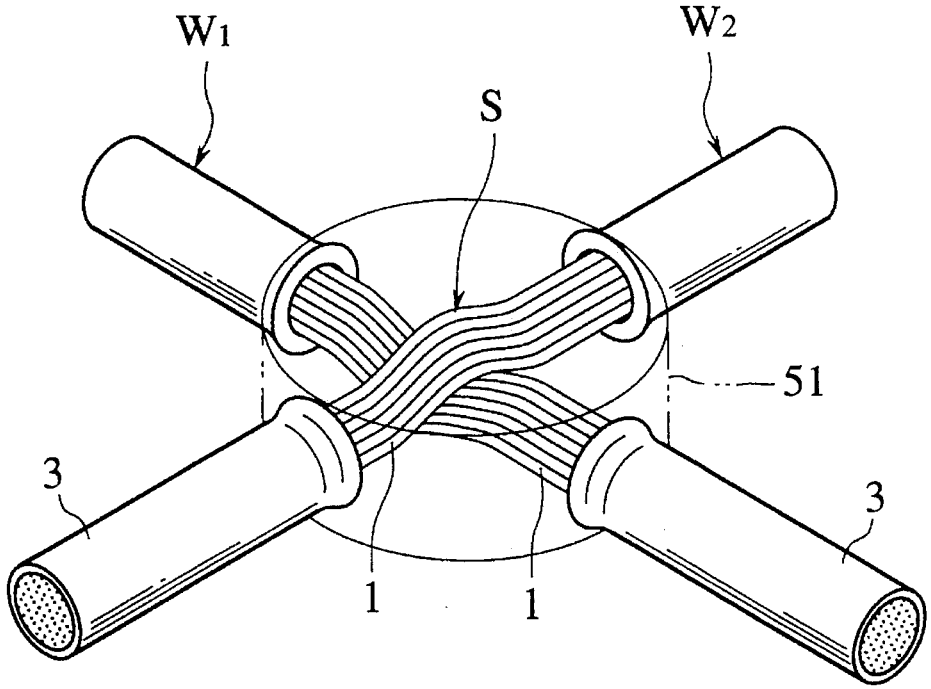

Next, the covered wire connection structure of the first embodiment which is obtained by the connection method as described above will be described. FIGS. 4A and 4B are perspective views showing the covered wire connection structure of the first embodiment, where FIG. 4A shows the outline of the connection structure, and FIG. 4B shows the internal structure of the connection structure.

In this connection structure, the two covered wires W1 and W2 cross each other at the connection portions in the resin material 51 comprising the pair of resin chips 53 and 55 as shown in FIG. 4A, and the conductive wire portions 1 of the covered wires W1 and W2 are exposed and conductively contacted with each other at the connection portions S thereof. The cover portions 3 adjacent to the conductively-contacted conductive wire portions 1 are melt-fixed to the resin material 51. With this melt-fixing the peripheral portions of the conductively-contacted conductive wire portions 1 are covered by the resin material 51, and the connection portions S are sealed by the resin material 51.

Next, the relationship between the material of the resin chips 53 and 55 and the conductivity of the covered wires will be described.

With respect to the conductivity, plural samples having the connection structure as described above are prepared in accordance with variation of the material of the resin chips, and the contact resistance (initial resistance) R of the covered wires is measured for each sample. The conductivity estimation is made by comparing average values and dispersion values of the samples.

Figure 5A:
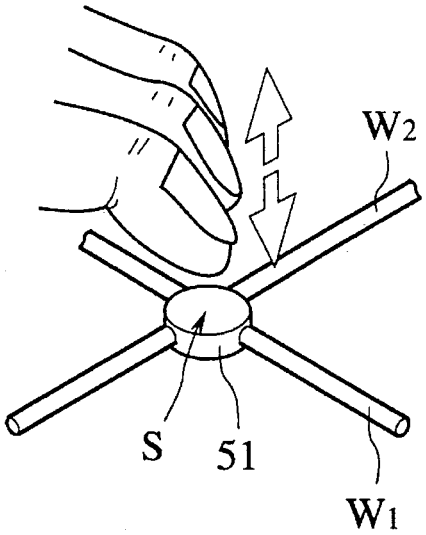
Figure 5B:
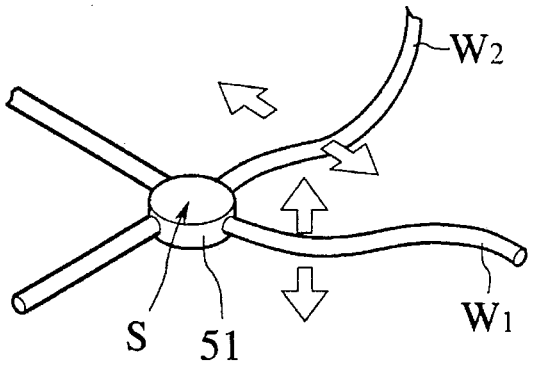

With respect to the stability of conductivity, an impact is given to the covered wires W1 and W2 and the connection portions S of each sample, for example by severely tapping the connection portions S (resin material 51) of the covered wires W1 and W2 as shown in FIG. 5A or by shaking the covered wires W1 and W2 while grasp them as shown in FIG. 5B, and then the contact resistance Ra (the after-impact resistance) of the covered wires is measured. The estimation of the stability of conductivity is made by comparing the after-impact resistance value with the initial resistance R. As the difference between the initial resistance R and the after-impact resistance Ra is smaller, the stability of conductivity is judged to be more excellent. The initial resistance R and the after-impact resistance Ra are calculated according to the following equations:

$$R=R_0-r\ X\ (x+y)$$

$$Ra=Ra_0-r\ X\ (x+y)$$

Figure 6:
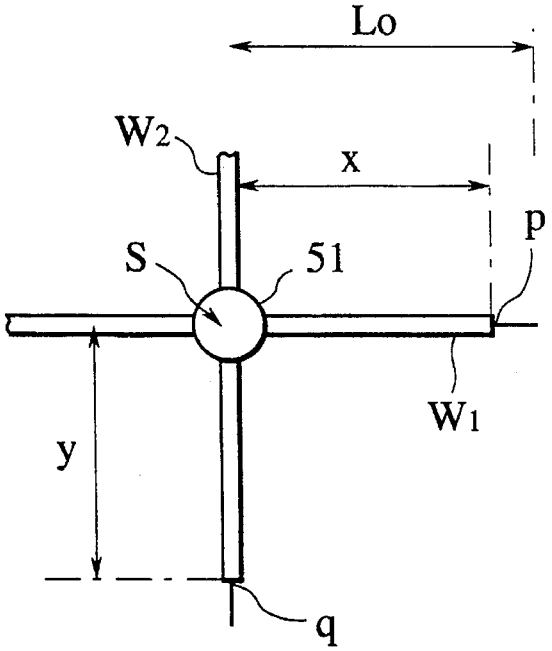
FIG. 6 is a plan view of a test sample.

$R_0$ and $Ra_0$ in the equations represent the resistance values (actual measurements) which are actually measured at terminal portions p and q of the covered wires W1 and W2 which are away from the connection portions S as shown in FIG. 6, r represents a wire resistance (3.27 mΩ per 100 mm) per unit length of an used conductive wire portion (CAVS·0.5 sg), and (x+y) represents the total wire length from the connection portions S to the terminal portions p and q of the covered wires W1 and W2. As the material of the resin chips 53 and 55 are used five kinds of materials, acrylic resin, PC resin, ABS resin, PE resin and PVC resin.

According to the estimation result, the acrylic resin provided the low contact resistance as a whole, and the extremely small dispersion between the samples. Furthermore, the difference before and after the impact was stably reduced to an extremely small value below 1 mΩ for all the samples. Therefore, the acrylic resin is expected to provide an excellent conductive state.

Of the other four kinds of materials, the PC resin provided the excellent and stable conductive state like the acrylic resin. Further, of the remaining three materials, the ABS resin provided the smallest dispersion and the least variation before and after impact, and also provided the most excellent and stable conductive state although these characteristics were inferior to those of the acrylic resin and the PC resin. Of the five kinds of materials, the PE resin provided the highest average value of the contact resistance, the largest dispersion and the worst conductive state.

Upon comparison of the melting state of the five kinds of resin materials as described above, the acrylic resin was most liable to transmit ultrasonic vibration, and the lower resin chip 55 was excited to the same extent as the upper resin chip 53. Therefore, the upper and lower resin chips were broken out substantially to the same extent. On the other hand, with respect to the other three kinds of resin materials, the upper and lower resin chips 53 and 55 were not broken out at the same level, and the upper resin chip 53 was broken out more greatly than the lower resin chip 55. Furthermore, with respect to the upper resin chip 53, the upper surface 53*b* of the upper resin chip 53 which was contacted with the horn 57 was more greatly broken out than the lower surface 53*a* thereof which was contacted with the lower resin chip 55.

With respect to the PE resin, the broken resin material 51 leaked from the gap between the confronting lower surface 53*a* of the upper resin chip 53 and the upper surface 55*a* of the lower resin chip 55, and from the upper surface 53*b* of the upper resin chip 53.

With respect to the ABS resin and the PVC resin, the resin material 51 leaked and was broken out like burr on the upper surface 53*b* of the upper resin chip 53 contacted with the horn 57.

Therefore, the acrylic resin provides the most excellent breaking state of the upper and lower resin chips 53 and 55, and thus it is proved to be excellent in external appearance and insulation.

Considering the above result totally, all the resins are expected to be practically usable in consideration of the conductivity and the stability of conductivity. However, in further consideration of the external appearance and the insulation it is proved that particularly the acrylic resin and the PC resin are the most suitable resin material, and the ABS resin is the second most suitable resin material.

Next, the relationship between the melt-fixing height and the conductivity and the relationship between the melt-fixing height and the mechanical strength will be described. Here, the melt-fixing height is defined as the total height of the melted upper and lower resin chips in the overlapping direction.

With respect to the estimation of the conductivity, plural sample groups which have the connection structure as described above, but have different melt-fixing heights are prepared (each group includes 20 samples having the same melt-fixing height). The contact resistance is measured for each sample, and an average value and a dispersion value in the contact resistance are calculated for the respective sample groups. The conductivity estimation is made by comparing the average value and the dispersion value between the respective sample groups. A specific method of calculating the contact resistant is identical to the initial resistance R.

With respect to the estimation of the mechanical strength, plural sample groups which have different melt-fixing heights are prepared (each group includes 10 samples having the same melt-fixing height), and a rupture test is conducted on each sample to measure a fixing force. The estimation is made on the basis of the comparison of the average values of the fixing force.

The melt-fixing height is adjusted, not by varying the setting of an exciting time for ultrasonic vibration, but by stopping emission of ultrasonic vibration when the melt-fixing height reaches a desired one. By this method, totally eight kinds of samples (2.9 mm, 3.1 mm, 3.3 mm, 3.4 mm, 3.5 mm, 3.6 mm, 3.7 mm, 3.8 mm) are prepared. As the other conditions, the pressure for pressing the horn is set to 1 $kg/cm^2$, a disc member which is formed of acrylic resin and has a diameter of 5 mm and a thickness of 2 mm is used as the resin chips, CAVS-0.5 sq is used as the covered wire, the wire length $L_0$ shown in FIG. 6 is set to 120 mm, and the resistance value of the wire is set to 2 mΩ.

Figure 8:
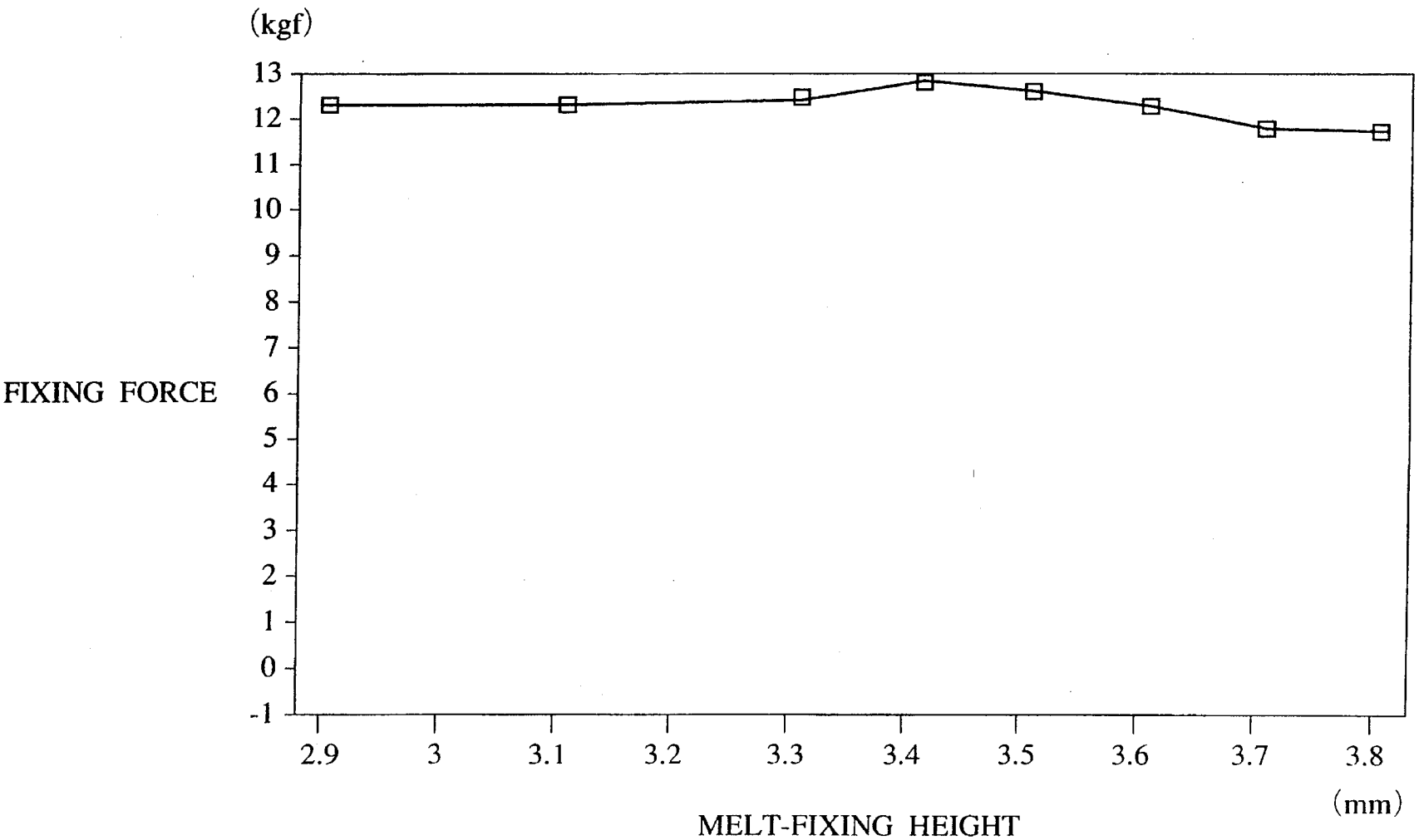
FIG. 8 is a graph corresponding to the table of FIG. 7 in which average values of fixing force are plotted for each melt-fixing height.

FIG. 7 is a table showing the result of the fixing force for each melt-fixing height of the acrylic resin, and FIG. 8 is a graph of the fixing force result of FIG. 7 in which the average values of the fixing force for each melt-fixing height in the table of FIG. 8 are plotted. In FIG. 7, samples which are affixed with a mark "•" in front of the respective numeric values correspond to those samples in which the conductive wire portion 1 is drawn out from the connection portion S and thus the connection structure is broken out, and samples which are affixed with no mark in front of the respective numeric values correspond to those samples in which the covered wires W1 and W2 exposed to the outside are broken out. The values at the bottom of the table represent standard deviation values.

According to the melt-fixing test result, the substantially same fixing force can be obtained even when the melt-fixing height is varied. The value of the melt-fixing is high, and the sufficient mechanical strength can be obtained.

As described above, according to the connection method of the first embodiment, the covered wires W1 and W2 are overlapped with each other at the connection portions S thereof, and the connection portions S are pinched by a pair of resin chips 53 and 55. In this state, the cover portions 3 of the covered wires are dispersively melted while being pressed from the outside of the resin chips 53 and 55, whereby the covered wires W1 and W2 can be conductively contacted with each other. Therefore, it is not required that the cover portions 3 are beforehand removed from the covered wires to connect the conductive wire portions of the covered wires to each other, and thus the conductive connection between the covered wires can be performed with a simple connection work.

Furthermore, according to the connection method and the connection structure as described above, after the covered wires W1 and W2 are conductively contacted with each other at the connection portions S thereof, the upper and lower resin chips 53 and 55 are melt-fixed to each other to seal the connection portions S. Therefore, the high mechanical strength can be obtained at the connection portions S by the resin chips 53 and 55 which are melted and then hardened around the connection portions S.

The resin chips 53 and 55 may be designed in such compact shape and size as to pinch the connection portions S of the covered wires W1 and W2 from the upper and lower sides thereof, the area required for connection can be reduced to a small one. In addition, the connection portions S are sealed by the resin chips 53 and 55, so that the sufficient insulation can be kept.

Accordingly, the conductivity characteristic between the covered wires W1 and W2 at the connection portions S thereof can be stabilized by the high mechanical strength and the sufficient insulation.

The connection method as described above is a relatively simple method in which the overlapped connection portions S are pinched by the resin chips 53 and 55, and the pressure and the excitation are applied to the connection portions S between the horn 57 and the anvil from the outside of the resin chips 53 and 55. In addition, in the connection method and the connection structure as described above, no special limitation in shape, etc. is imposed on the other member (the covered wire W2 in this embodiment) to be conductively connected to the covered wire W1. Therefore, the connection method and the connection structure as described above is applicable to various connection modes such as a connection mode between the covered wires W1 and W2, a connection mode between the covered wire W1 and a terminal, etc., so that the practical use of this invention can be widened.

Furthermore, the covered wires W1 and W2 are pinched by a pair of resin chips 53 and 55 from the upper and lower sides of the covered wires in the overlapping direction, and then the connection portions S of the covered wires are pressed and excited from the outside of the resin chips 53 and 55 between the horn 57 and the anvil 59. In this case, the press direction is set to be coincident with the overlapping direction of the covered wires W1 and W2. Therefore, when the connection portions S are pressed, the melted cover portions 3 are extruded from the center side of the resin chips 53 and 55 toward the outside thereof, and the conductive wire portions 1 are exposed excellently, so that the conductive wire portions can be surely conductively contacted with each other. Furthermore, like the press direction, the direction of the excitation of the connection portions S is set to be coincident with the overlapping direction of the covered wires W1 and W2, so that the resin chips 53 and 55 can be kept in a good melt-fixing state, and the action of extruding the melted cover portions 3 can be promoted.

Still furthermore, when the resin material 51 is formed of transparent material in the first embodiment, the conductive contact state of the conductive wire portions 1 can be viewed from the outside of the resin material 51. Therefore, facilitation of a quality management and improvement of quality can be promoted.

Next, a second embodiment of the present invention will be described.

Figure 9A:
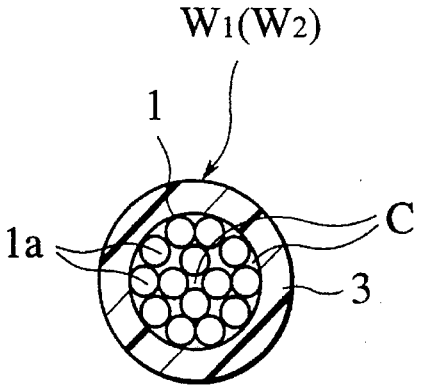
Figure 9B:
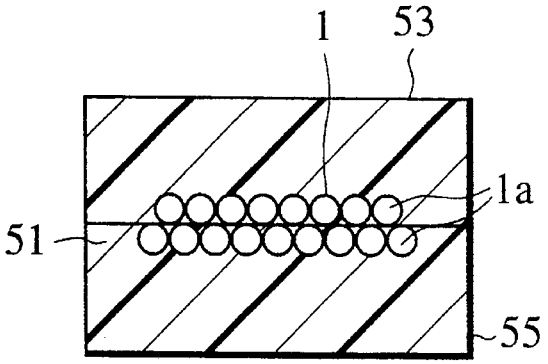

FIGS. 9A and 9B are cross-sectional views of those portions which are near to the connection portions of the covered wires which are connected to each other by a second embodiment of the connection method, where FIG. 9A is a cross-sectional view (P—P section in FIG. 3) showing a state of the covered wire W1 (W2) before the connection is performed, and FIG. 9B is a cross-sectional view (Q—Q section in FIG. 3) showing a state of the covered wire after the connection is performed. The same elements as the first embodiment are represented by the same reference numerals, and the duplicate description thereof is omitted.

The second embodiment relates to a connection method which is basically identical to that of the first embodiment except for the following point. That is, in this embodiment, when the resin chips 53 and 55 are melt-fixed to each other while pinching the connection portions S, the melted resin chips 53 and 55 are filled into gaps between plural core wires la constituting each conductive wire portion 1 as shown in FIG. 9B, except for those core wires which are located at the connection portions S. A material having relatively low viscosity at the melting time is used for the resin chips because it can be easily filled into the gaps between the core wires 1*a*.

According to the second embodiment, in addition to the action and effect of the first embodiment, a waterproof (water stopping) effect can be obtained in the covered wires W1 and W2 because those gaps C which are formed between the core wires 1*a* and the cover portions 3 of the covered wires as shown in FIG. 9A are filled with the resin material 51 as shown in FIG. 9B, so that the gaps C are shield by the resin material 51.

Accordingly, for example, in a case where one end of the covered wire W1 (W2) is connected to a member needing waterproof (waterproof member) and the other end thereof is connected to a member which functionally needs no waterproof (non-waterproof member), even when water invades into the covered wire W1 (W2) from the other end thereof due to the capillary phenomenon and flows through the covered wire, the flowing of water to the one end of the covered wire can be prevented by the waterproof connection structure of the covered wire. Therefore, the waterproof of the one end side of the covered wire can be kept without subjecting the other end of the covered wire to the waterproof treatment. That is, when both ends of the covered wire W1 (W2) are connected to a waterproof member and a non-waterproof member respectively, the waterproof property can be kept for the waterproof member by the simple and low-cost method and structure without subjecting the non-waterproof member to the waterproof treatment.

Next, a third embodiment according to the present invention will be described.

Figure 10:
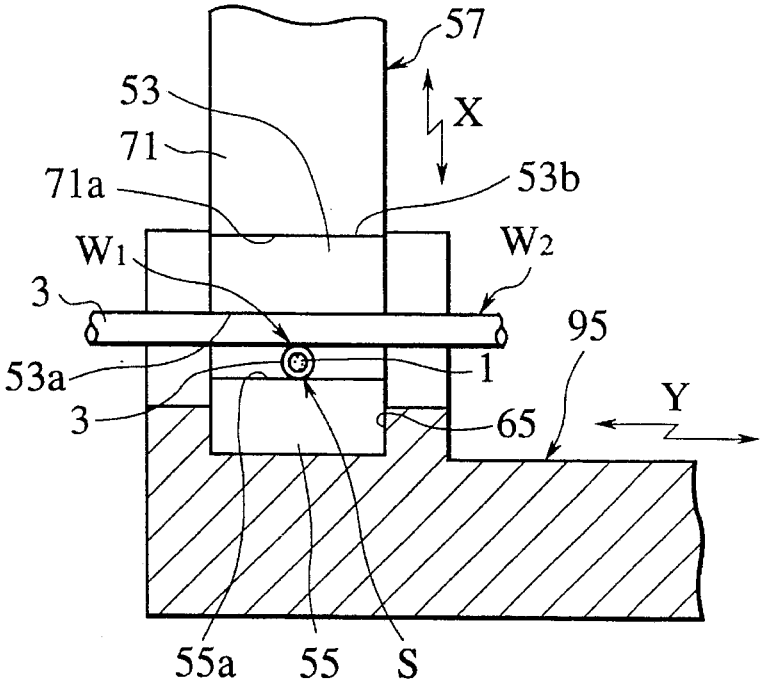
FIG. 10 is a cross-sectional view of a connection system for obtaining a covered wire connection structure of a third embodiment.

FIG. 10 is a cross-sectional view of the system for connecting the covered wires according to the third embodiment. The same elements as the first embodiment are represented by the same reference numerals, and the duplicate description thereof is omitted.

In the third embodiment, as shown in FIG. 10, ultrasonic vibration in the longitudinal direction (in the direction as indicated by an arrow X in FIG. 10) is emitted from the horn 57 like the first embodiment, and another ultrasonic vibration in the lateral direction (in the direction as indicated by an arrow Y in FIG. 10) is emitted from an anvil 95 having the substantially same shape as the anvil 59 of the first embodiment (see FIG. 3). That is, the connection portions of the covered wires W1 and W2 are excited three-dimensionally by two vibration components, i.e., a longitudinal vibration component produced in the horn 57 whose direction (X-direction) is coincident with the overlapping direction of the covered wires W1 and W2, and a lateral vibration component produced in the anvil 95 whose direction (Y-direction) is perpendicular to the overlapping direction of the covered wires W1 and W2.

According to the third embodiment, the vibration component in the longitudinal direction serves to make excellent the melt-fixing state of the resin chips 53 and 55 like the first embodiment, and the vibration component in the lateral direction serves to promote the action of extruding the melted cover portions 3 from the center side of the resin chips 53 and 55 toward the outside thereof.

When metals are joined to each other by ultrasonic vibration, the joint can be most easily performed by the excitation along the contact surfaces of the metals. Therefore, the conductive wire portions 1 are connected to each other in a broad area by the excitation in the lateral direction. Accordingly, the conductivity characteristic at the connection portions S can be excellently kept even when the covered wires W1 and W2 are used under any severe condition, for example, even when these wires are intensely pulled.

Figure 11:
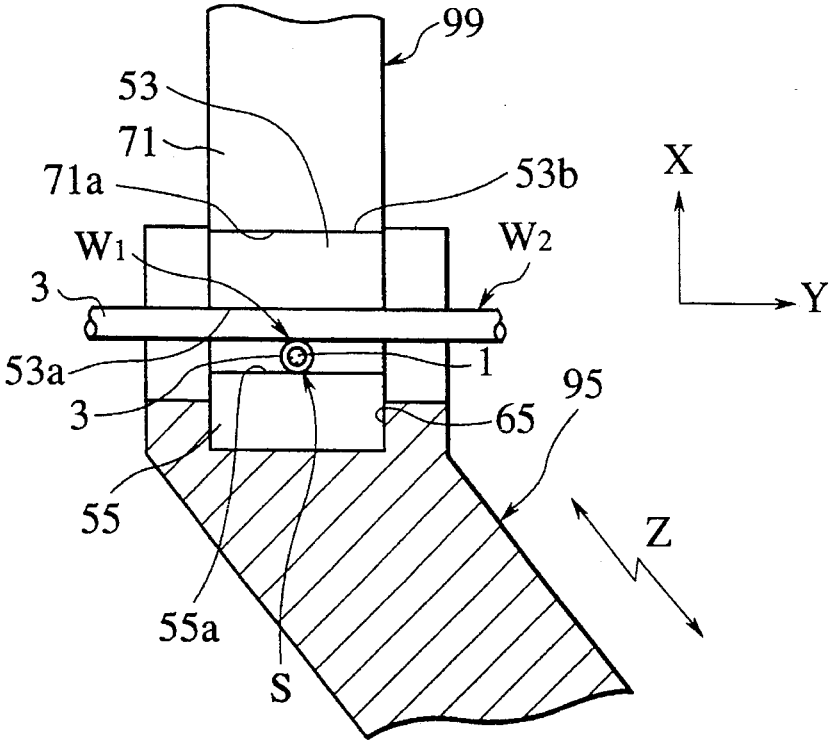
FIG. 11 is a cross sectional view of a modification of the third embodiment.

Furthermore, since the metallic connection of the conductive wire portions 1 are enlarged, heating which occurs at the connection portions S when a current is supplied through the covered wires can be suppressed. Accordingly, even when a relatively-low cost resin material is used for the resin chips, the same action and effect as obtained when an expensive resin material is used, and thus the manufacturing cost can be reduced.FIG. 11 shows a modification of the third embodiment. In this embodiment, an anvil 97 for producing vibration in an oblique direction (Z-direction) which contains a longitudinal vibration component in the longitudinal direction (X-direction) and a lateral vibration component in the lateral direction (Y-direction) is provided in place of the anvil 95 of the third embodiment (see FIG. 10), and a horn 99 which has no function of producing the ultrasonic vibration and has only a function of pressing the connection portions S is also provided. That is, through the vibration operation of the anvil 97, the connection portions S are excited by the longitudinal vibration component in the longitudinal direction and the lateral vibration component in the lateral direction like the third embodiment.

According to this modification, the same action and effect as the third embodiment can be obtained by merely actuating the anvil 97 to produce the ultrasonic vibration, and thus the device itself can be simplified.

Next, a fourth embodiment of the present invention will be described with respect to FIG. 12 to FIGS. 14A and 14B.

Figure 12:
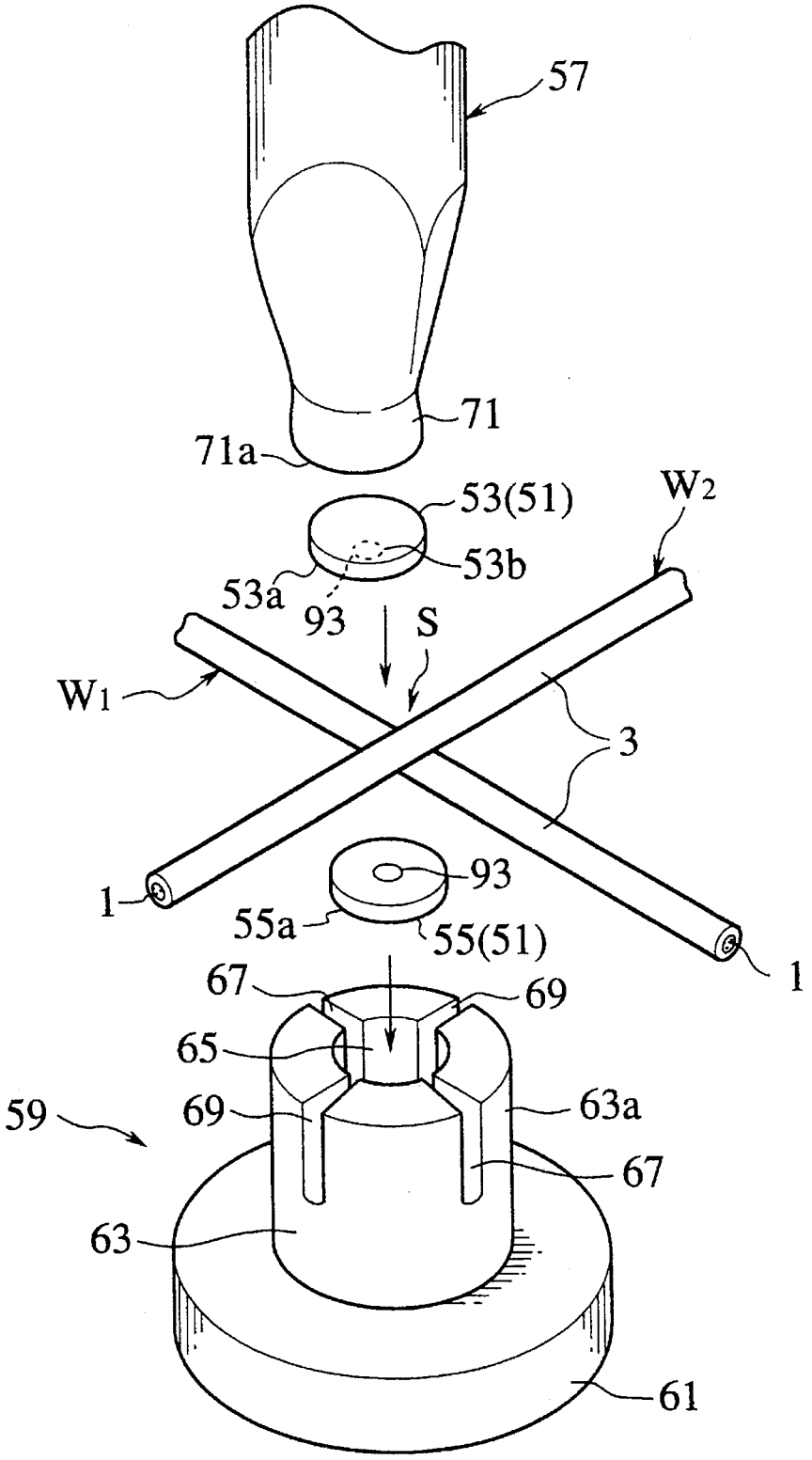
FIG. 12 is a perspective view showing a connection system for obtaining a covered wire connection structure of a fourth embodiment.
Figure 13A:
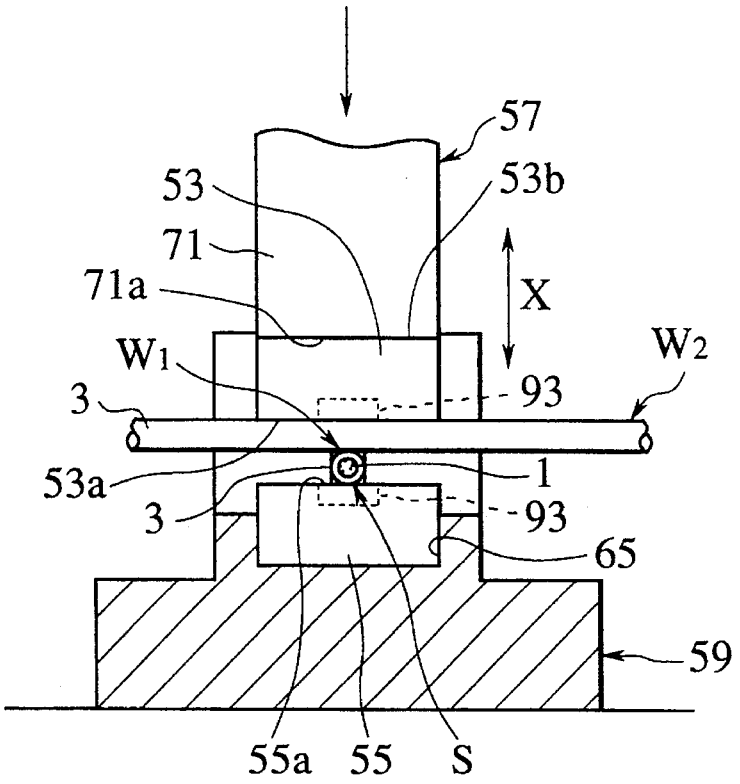
Figure 13B:
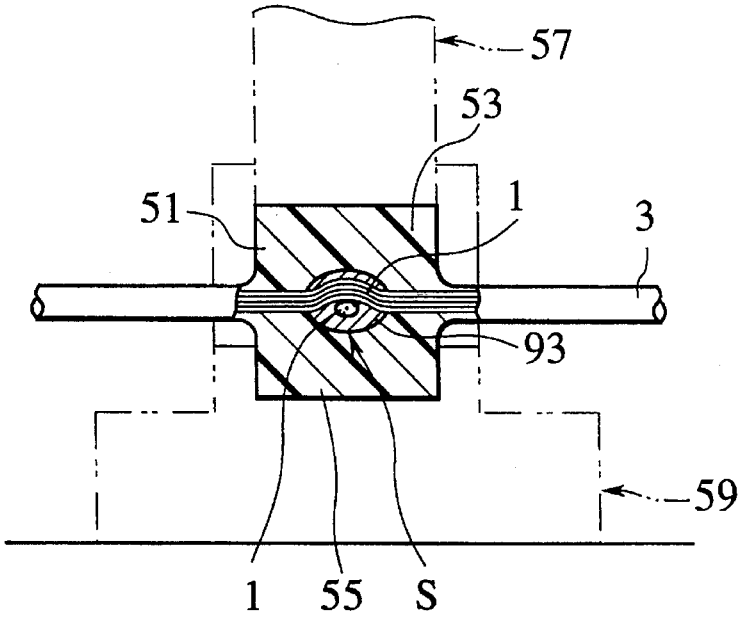
Figure 14A:
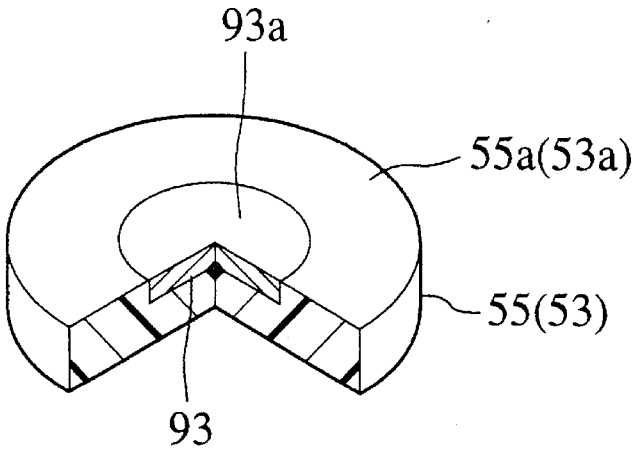
FIG. 14 is a perspective view showing a resin chip used in the fourth embodiment, which partially contains a cross-sectional view of the resin chip.
FIG. 14B is a perspective view showing the covered wire connection structure of the fourth embodiment, which partially contains a cross-sectional view thereof.
Figure 14B:
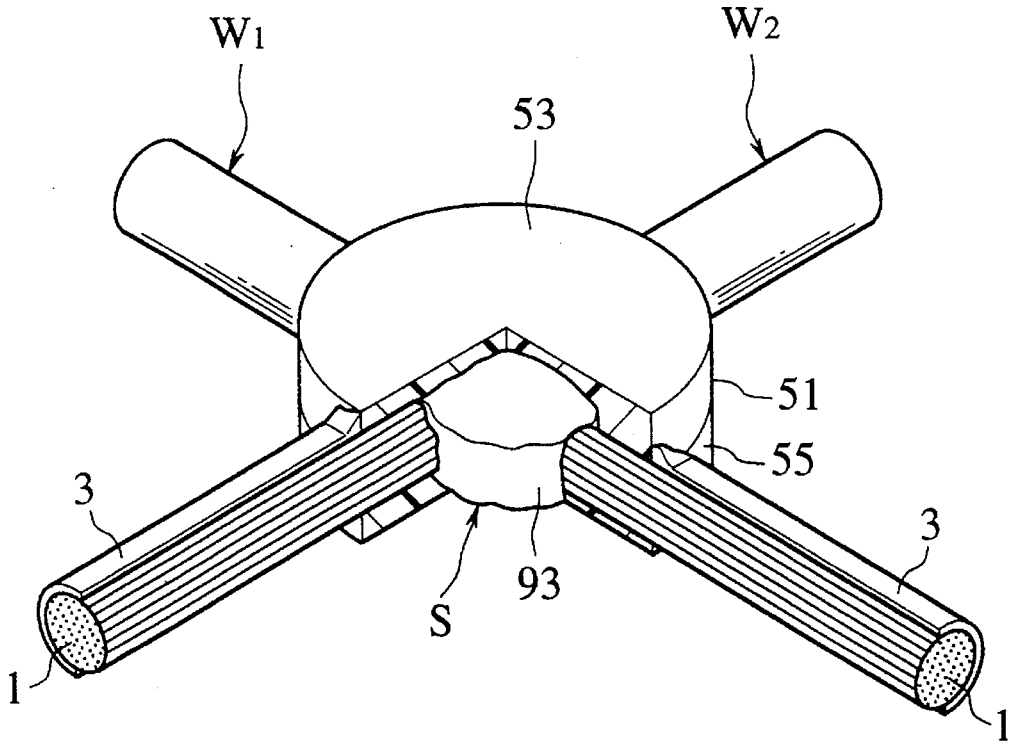

FIG. 12 is a perspective view showing a connection system for obtaining a covered wire connection structure according to the fourth embodiment, and FIGS. 13A and 13B are cross-sectional views showing the connection system after the covered wires are connected to each other, where FIG. 13A shows a state just after the connection is started, and FIG. 13B shows a state after the connection is performed. FIG. 14A is a perspective view of a resin chip of the fourth embodiment, which partially contains a cross-sectional view of the resin chip, and FIG. 14B is a perspective view showing the connection structure of the covered wires of the fourth embodiments, which partially contains a cross-sectional view thereof. The same elements as the first embodiment are represented by the same reference numerals, and the description thereof is omitted.

As shown in FIGS. 12, 13A and 13B, in the fourth embodiment, each of the resin chips 53 and 55 is provided with a soldering member 93 formed of brazing material or the like, and the conductive wire portions 1 of the covered wires W1 and W2 are brazed with the brazing material 93 in the resin material 51 when the connection portions S of the covered wires are connected to each other while pinched by the resin chips 53 and 55.

The covered wire connection method according to the fourth embodiment is substantially identical to that of the first embodiment except that the disc-shaped soldering member 93 is provided to each of the resin chips 53 and 55.

FIG. 14A shows the lower resin chip 55, and the soldering member 93 is engagedly placed at the central portion of the upper surface 55*a* of the resin chip 55 so that the circular upper surface 93*a* of the soldering member 93 is located on the substantially same plane as the upper surface 55*a* of the lower resin chip 55. Likewise, the other soldering member 93 is engagedly placed at the central portion of the lower surface 53*a* of the upper resin chip 53 so that the circular upper surface of the soldering member 93 is located on the substantially same plane as the lower surface 53*a* of the upper resin chip 53.

Specifically, like the first embodiment, the resin chips 53 and 55 are inserted into the bore portion 65 of the anvil 59, and the overlapped connection portions S of the covered wires W1 and W2 are pinched by the resin chips 53 and 55. With this operation, the connection portions S are pinched between the soldering members 93 of the upper and lower resin chips 53 and 55.

Subsequently, the connection portions S are pressed and excited between the horn 57 and the anvil 59 from the outside of the upper and lower resin chips 53 and 55, whereby the conductive wire portions 1 of the covered wires W1 and W2 are exposed at the connection portions S between the resin chips 53 and 55 and conductively connected to each other as shown in FIG. 13B.

When the press and excitation of the connection portions S is further continued, the resin chips 53 and 55 are melted and the confronting surfaces of the resin chips 53 and 55 (the lower surface 53*a* of the upper resin chip 53 and the upper surface 55*a* of the lower resin chip 55) are melt-fixed to each other. In addition, the outer peripheral surfaces of the cover portions which are near to the conductively-contacted conductive wire portions 1 are melt-fixed to the resin chips 53 and 55, so that the peripheral portions of the conductively-contacted conductive wire portions 1 are covered with the resin chips 53 and 55.

Furthermore, the soldering members 93 provided to the resin chips 53 and 55 are melted due to the heat occurring when the resin chips 53 and 55 are melted, so that the conductive wire portions 1 of the covered wires W1 and W2 which are conductively contacted with each other at the connection portions S thereof are brazed to each other with the soldering members.

After the melting of the resin chips 53 and 55, the press and excitation operation of the horn 57 is stopped to harden the cover portions 3, the resin chips 53 and 55 and the soldering members 93, and then the connection work is finished.

Next, the covered wire connection structure obtained by the connection method of the fourth embodiment will be described.

As shown in FIG. 14B, in this connection structure, the two covered wires W1 and W2 are placed so as to cross each other at the connection portions S thereof inside of the resin material 51 comprising the pair of resin chips 53 and 55, and the conductive wire portions 1 of the covered wires W1 and W2 are exposed and conductively contacted with each other at the connection portions S thereof. In addition, these contacted portions of the covered wires are brazed to each other with the soldering members 93. The cover portions 3 which are located adjacent to the conductively-contacted conductive wire portions 1 are melt-fixed to the resin material 51, whereby the conductively-contacted conductive wire portions 1 are covered with the resin material 51 and thus the connection portions S are sealed by the resin material 51.

According to the connection method and the connection structure, in addition to the effect of the first embodiment, a higher electrical performance can be obtained at the connection portions S because the conductive wire portions 1 of the covered wires W1 and W2 are brazed with the soldering members such as brazing material, and the conductivity characteristic can be more stabilized.

Furthermore, the soldering members 93 are provided to the resin chips 53 and 55 to braze the conductive wire portions 1 of the covered wires using the heat occurring when the resin chips 53 and 55 are melted. Therefore, no special brazing work is required, and the electrical performance of the connection portions S can be improved by a simple method of merely using the resin chips 53 and 55 provided with the soldering members 93.

Still furthermore, when the resin material 51 is formed of transparent material, not only the conductive contact state of the conductive wire portions 1, but also the brazing state of the conductive wire portions 1 can be viewed from the outside of the resin material 51.

Still furthermore, like the second embodiment (see FIG. 9), when the melted resin chips 53 and 55 are filled into the gaps between the neighboring core wires 1*a* of the conductive wire portions 1 except for the connection portions S, the waterproof (water stopping) effect can be also obtained in the covered wires W1 and W2.

Next, a fifth embodiment according to the present invention will be described with reference to FIGS. 15, 16A and 16B.

Figure 15:
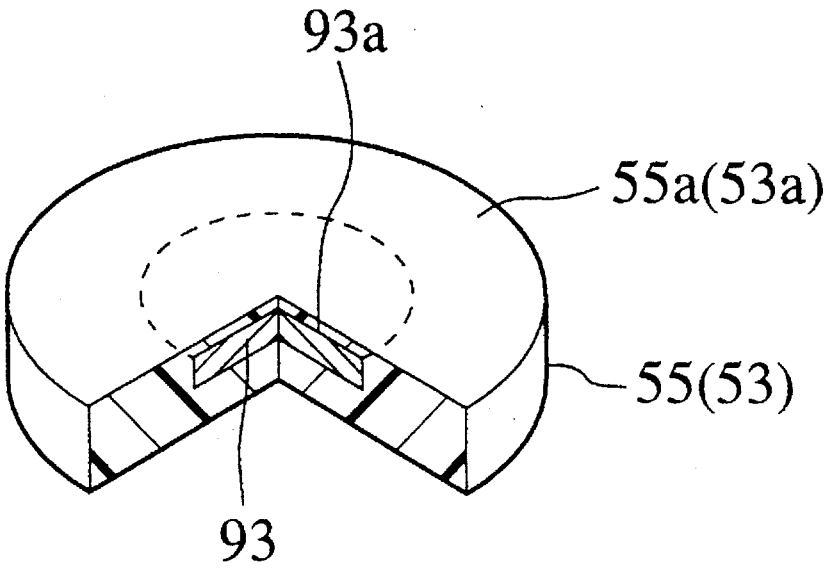
FIG. 15 is a perspective view showing a resin chip used in a fifth embodiment, which partially contains a cross-sectional view thereof.
Figure 16A:
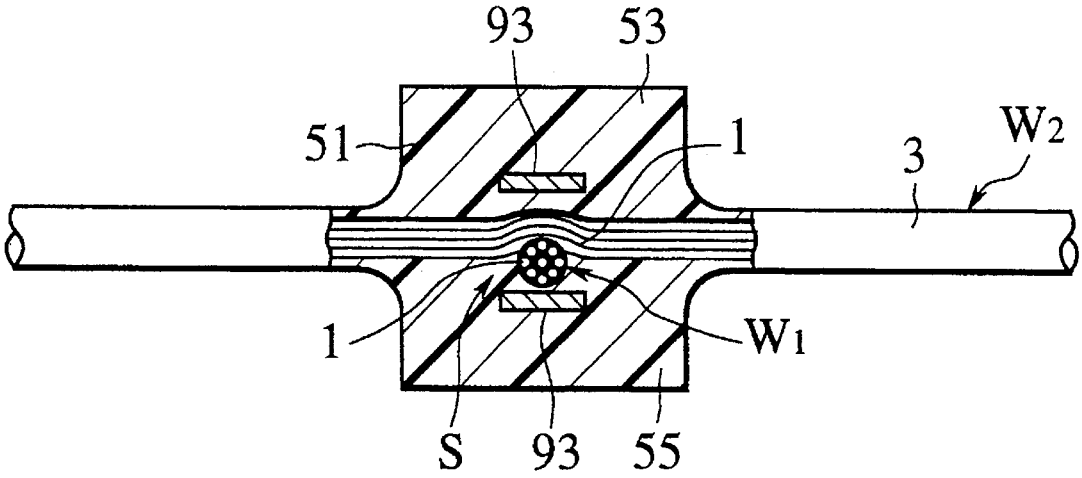
Figure 16B:
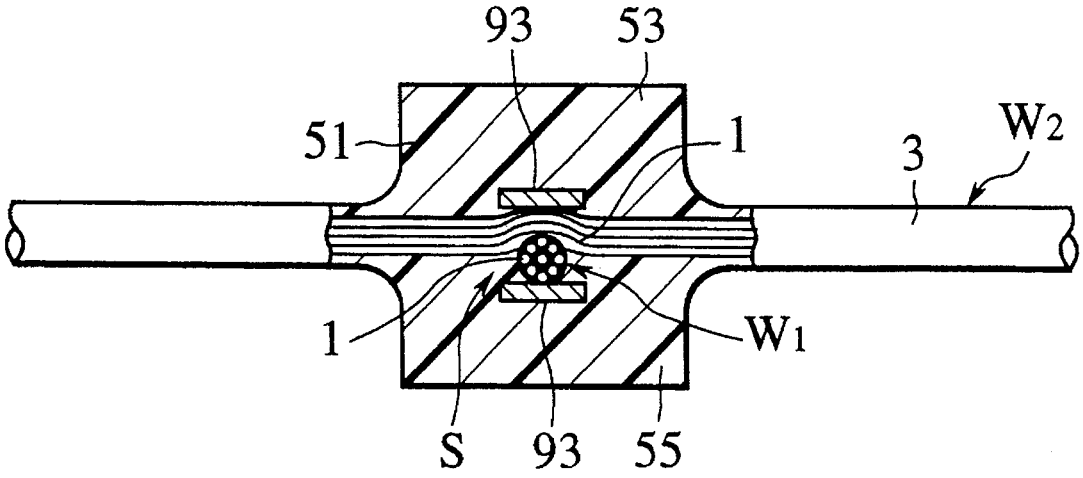

FIG. 15 is a perspective view showing a resin chip used in the fifth embodiment, which partially contains a cross-sectional view, and FIGS. 16A and 16B are cross-sectional views of a connection state of the covered wires.

The connection structure of the fifth embodiment is substantially identical to that of the fourth embodiment except that the soldering members 93 shown in FIG. 15 are buried in the resin chips 53 and 55. That is, the circular upper surface 93*a* of each soldering member 93 is covered by the resin chip 53 (55), and no soldering member 93 is exposed from the circular upper surfaces 53*a* and 55*a* of the upper and lower resin chips 53 and 55.

The connection method of the fifth embodiment is substantially identical to that of the fourth embodiment. That is, the resin chips 53 and 55 are first inserted into the bore portion 65 of the anvil 59, and the overlapped connection portions S of the covered wires W1 and W2 are pinched by the resin chips 53 and 55 from the upper and lower sides of the covered wires (see FIG. 13A).

Subsequently, the connection portions S are pressed and excited between the horn 57 and the anvil 59 from the outside of the upper and lower resin chips 53 and 55. Through this operation, the conductive wire portions 1 of the covered wires W1 and W2 are exposed and conductively contacted with each other at the connection portions S between the resin chips 53 and 55 as shown in FIG. 16A. When the press and excitation of the connection portions S are further continued, the resin chips 53 and 55 are melted and fixed to each other as shown in FIG. 16B. At the same time, the outer peripheral surfaces of the cover portions 3 which are near to the conductively-contacted conductive wire portions 1 are melt-fixed to the resin chips 53 and 55, so that the conductively-contacted conductive wire portions 1 are covered with the resin chips 53 and 55. In this state, the soldering members 93 which are buried in the resin chips 53 and 55 are exposed and contacted with the conductive wire portions 1. At this time, the soldering members 93 are melted by the heat occurring when the resin chips 53 and 55 are melted, and thus the conductive wire portions 1 which are conductively contacted with each other are brazed with the melted soldering members 93 at the connection portions S between the resin chips 53 and 55 (see FIG. 13B).

After the resin chip 53 and 55 are melted, the pressing and exciting operation of the horn 57 is stopped to harden the cover portions 3, the resin chips 53 and 55 and the soldering members 93, and the connection work is finished.

As described above, according to the fifth embodiment, the cover portions 3 of the covered wires W1 and W2 are melted and dispersed from the center side of the resin chips 53 and 55 toward the outside thereof, so that the respective conductive wire portions 1 of the covered wires W1 and W2 are exposed and conductively contacted with each other at the connection portions S, and the connection portions S are covered with the resin chips 53 and 55. Thereafter, the soldering members 93 are exposed from the resin chips 53 and 55 and melted out. Therefore, the conductively-contacted conductive wire portions 1 can be surely brazed and the melted soldering members 93 can be surely prevented from flowing out from the resin chips 53 and 55. Accordingly, the connection state and the connection workability can be improved.

Next, a sixth embodiment according to the present invention will be described with reference to FIGS. 17 to 21.

Figure 17:
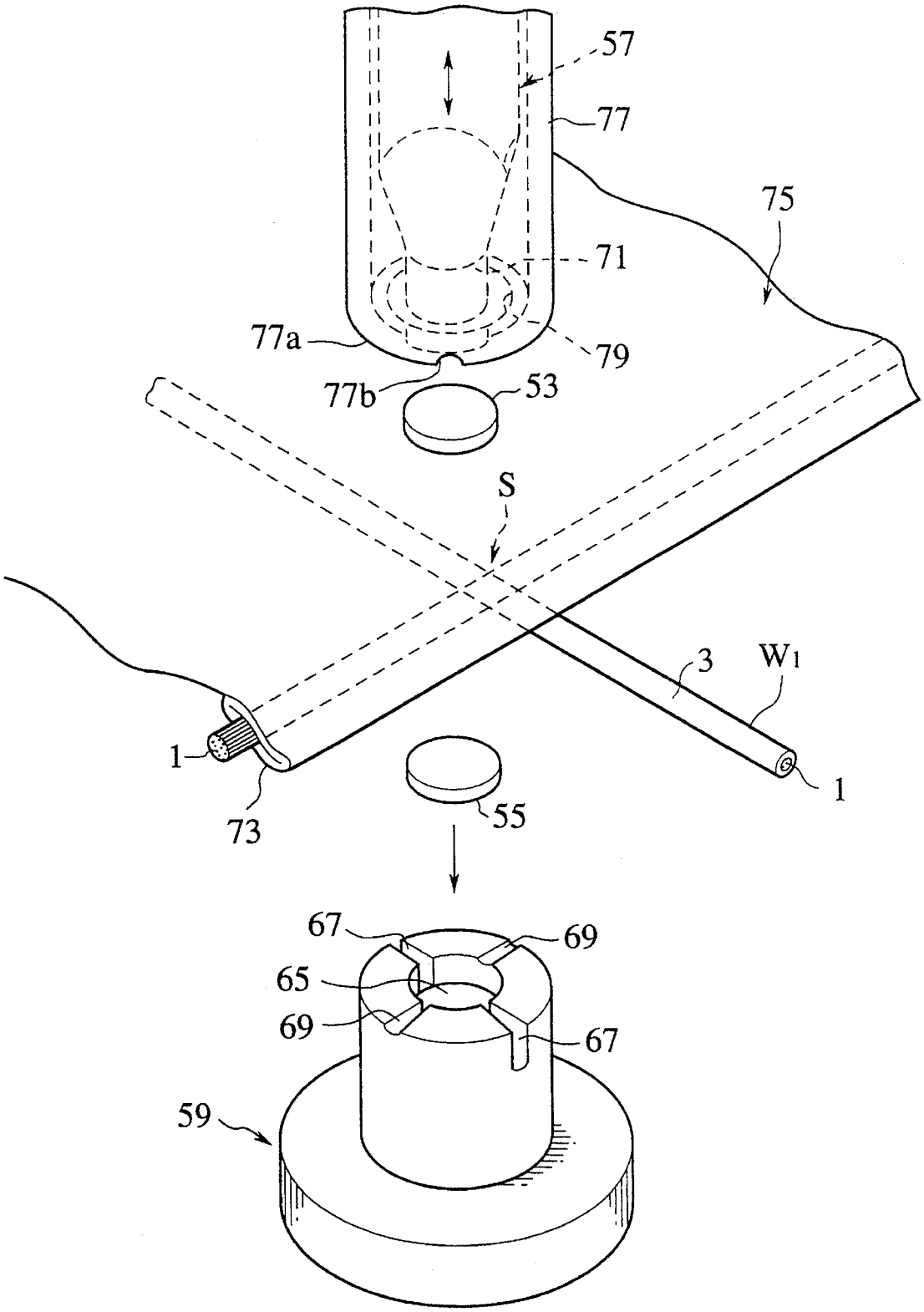
FIG. 17 is a perspective view showing a connection system for obtaining a covered wire connection structure of a sixth embodiment before the connection.
Figure 18:
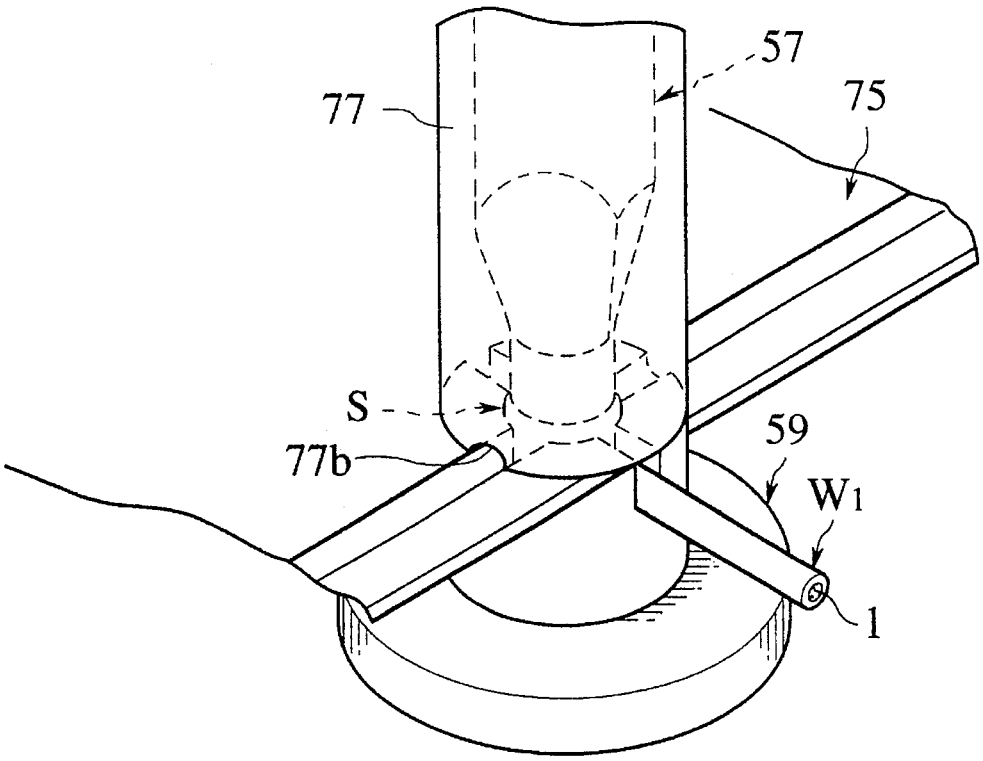
FIG. 18 is a perspective view showing the connection system of FIG. 17 during the connection process.
Figure 19:
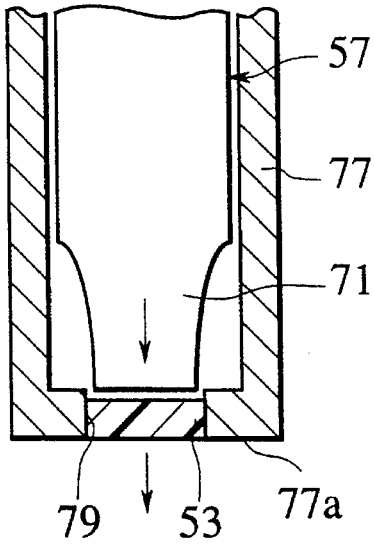
FIG. 19 is a cross-sectional view of a horn of FIG. 17.
Figure 20:
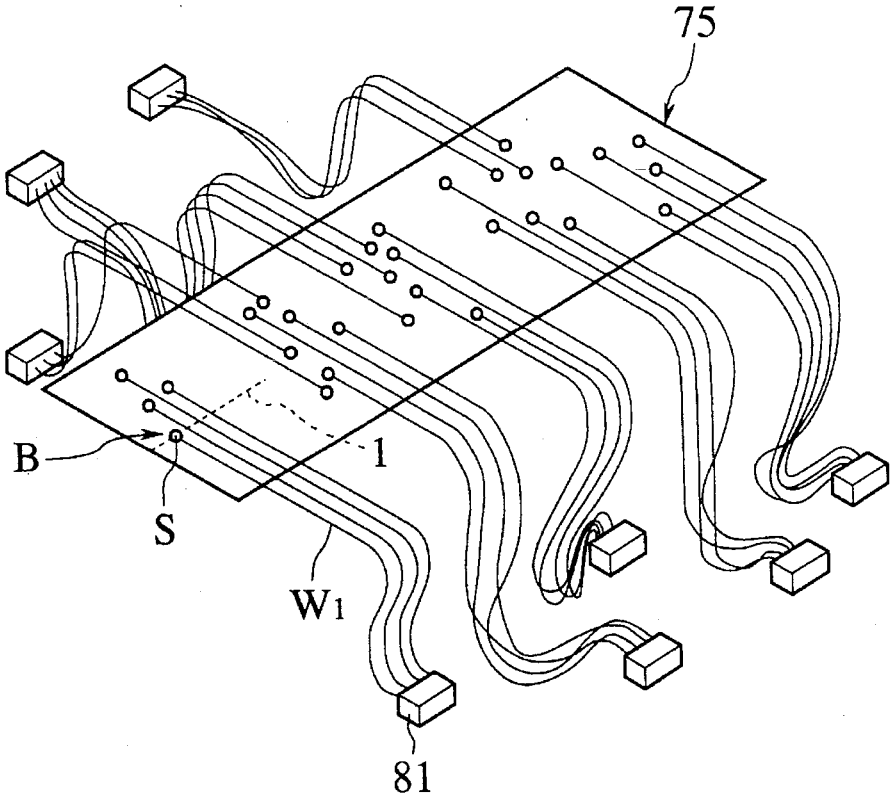
FIG. 20 is a perspective view of a flat cable.

FIGS. 17 and 18 are perspective views showing a connection system for obtaining the covered wire connection structure according to the sixth embodiment, where FIG. 17 shows a system state before the connection is started, and FIG. 18 shows a system state after the connection is started. FIG. 19 is a cross-sectional view of the horn shown in FIG. 17, and FIG. 20 is a perspective view of the whole construction of a flat cable. The same elements as the first embodiment are represented by the same reference numerals, and the duplicate description thereof is omitted.

In the sixth embodiment, a member to be conductively connected to the covered wire is a flat cable which comprises a sheet-shaped cover portion 73 of resin and plural conductive wire portions 1 which are juxtaposed in the cover portion 73. That is, the covered wire 1 and at least one of the conductive wire portions of the flat cable are conductively connected to each other at the connection portions S thereof.

The covered wire connection method of the sixth embodiment is substantially identical to that of the first embodiment. That is, the lower resin chip 55 is inserted into the bore portion 65 of the anvil 59, and then the covered wire W1 is inserted into the groove portions 67 and placed on the lower resin chip 55 so that the connection portion S thereof is located substantially at the center of the bore portion 65. Thereafter, a conductive wire portion 1 in the cover portion 73 of the flat cable 75 is inserted into the groove portions 69 and placed on the covered wire W1 so that the connection portion S thereof is located substantially at the center of the bore portion 65. In this case, the conductive wire portion 1 cannot be perfectly inserted into the groove portions 69 because the cover portion 73 is designed in a sheet shape, and thus the flat cable 75 is merely mounted on the anvil 59 so that the conductive wire portion to be connected to the covered wire is placed along the groove portions 69 as shown in FIG. 18. In order to meet this arrangement, the bore portion 65 and the groove portions 67 and 69 are designed to be shallow. Furthermore, when the upper resin chip 53 is put on the flat cable 75 mounted on the anvil 59, the resin chip 53 is merely mounted on the flat cable 75, and thus a positioning work for the resin chip 53 and the press and excitation operation are difficult to be carried out. In order to overcome this disadvantage, a cylindrical chip holder 77 is provided at the outside of the horn 57 as shown in FIG. 17. The lower end 77*a* of the chip holder 77 is provided with an opening portion 79 through which the head portion 71 of the horn 57 is passed and in which the upper resin chip 53 is temporarily held. Accordingly, as shown in FIG. 19, the lower end 77*a* of the chip holder 77 is erectly set on the flat cable 75 so as to meet the bore portion 65 of the anvil 59 while the upper resin chip 53 is temporarily held at the opening portion 79, and the horn 57 is pressed to extrude the temporarily-held upper resin chip 53 downwardly, whereby the connection portions S are pinched by the upper and resin chips 53 and 55 as shown in FIG. 18. Furthermore, groove portions 77*b* which have the arcuate shape in section and are engageable with the conductive wire portion 1 of the flat cable 75 from the outside of the cover portion 73 are formed at the lower end of the chip holder 77, and the positioning of the upper resin chip 53 when the chip holder 77 is erectly set on the flat cable 75 can be easily performed with these groove portions 77*b*. The subsequent connection steps are identical to those of the first embodiment.

Figure 21:
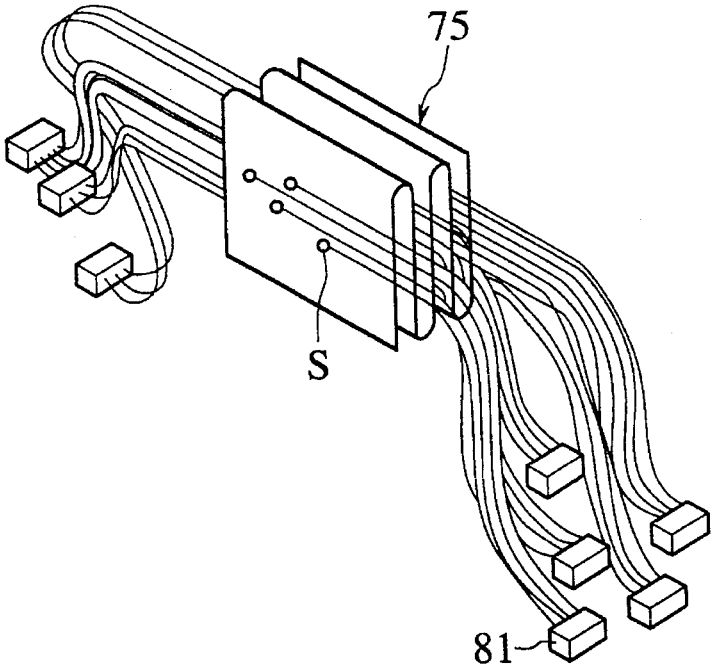
FIG. 21 is a perspective view showing a folded (use) state of the flat cable of FIG. 20.

The covered wire connection structure of the sixth embodiment which is obtained by the connection method as described above is substantially identical to that of the first embodiment shown in FIG. 4. For example, in the connection structure at the B portion of FIG. 20, a conductive wire portion 1 of a covered wire connected to a connector 81 and a conductive wire portion 1 of a flat cable 75 are exposed and conductively contacted with each other so as to cross each other at the connection portions S thereof in the resin material 51 comprising a pair of resin chips 53 and 55. The cover portions 3 which are adjacent to the conductively-contacted conductive wire portions 1 are melt-fixed to the resin material 51, and the conductively-contacted conductive wire portions 1 are covered with the resin material 51, so that the connection portions S are sealed by the resin material 51. FIG. 21 is a perspective view showing a folded state (use state) of the flat cable.

According to the sixth embodiment, the same effect as the first embodiment can be obtained even when the flat cable 75 is conductively connected to the covered wire W1.

Furthermore, the same effect can be also obtained when both flat cables 75 are conductively connected to each other. When the resin material 51 is formed of transparent material, the conductive contact state of the conductive wire portions 1 can be also viewed from the outside.

Next, a seventh embodiment according to the present invention will be described.

Figure 22:
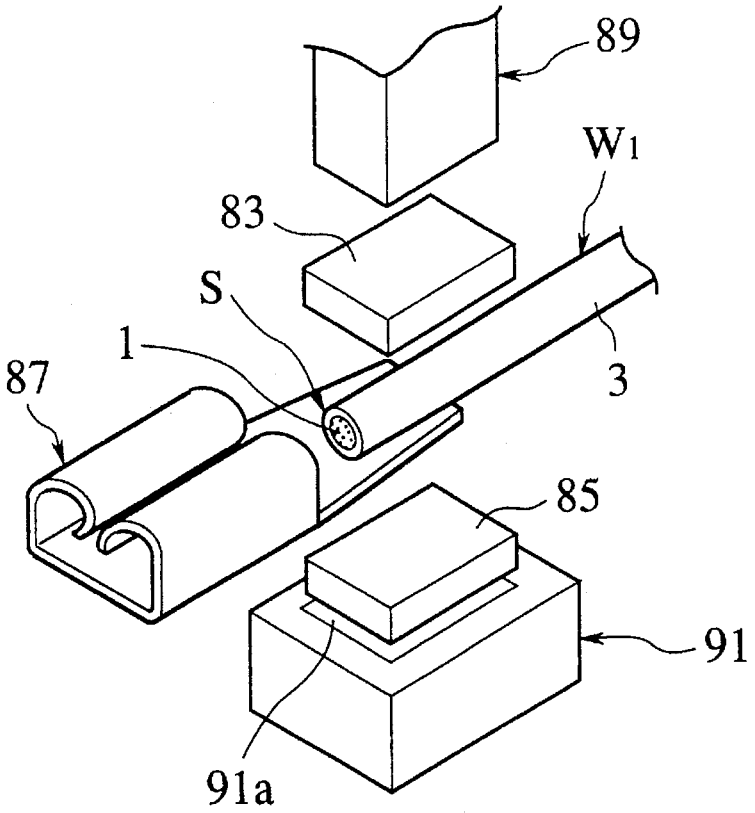
FIG. 22 is a perspective view showing a connection system for obtaining a covered wired connection structure of a seventh embodiment before the connection process.
Figure 23:
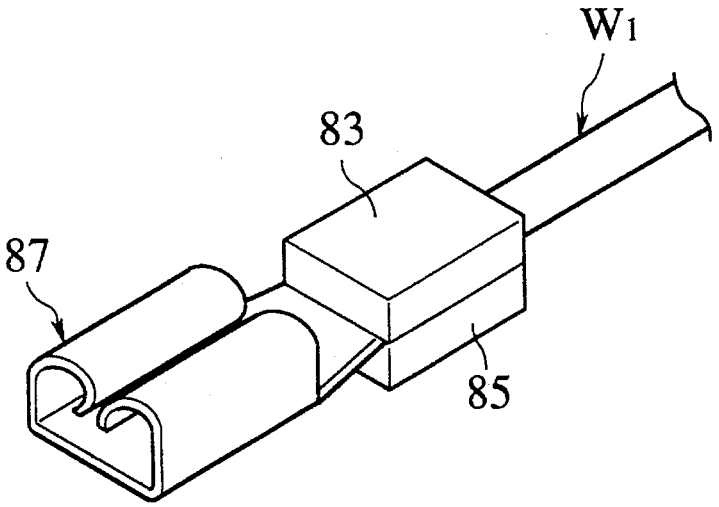
FIG. 23 is a perspective view showing the connection system of FIG. 22 after the connection process.
Figure 24:
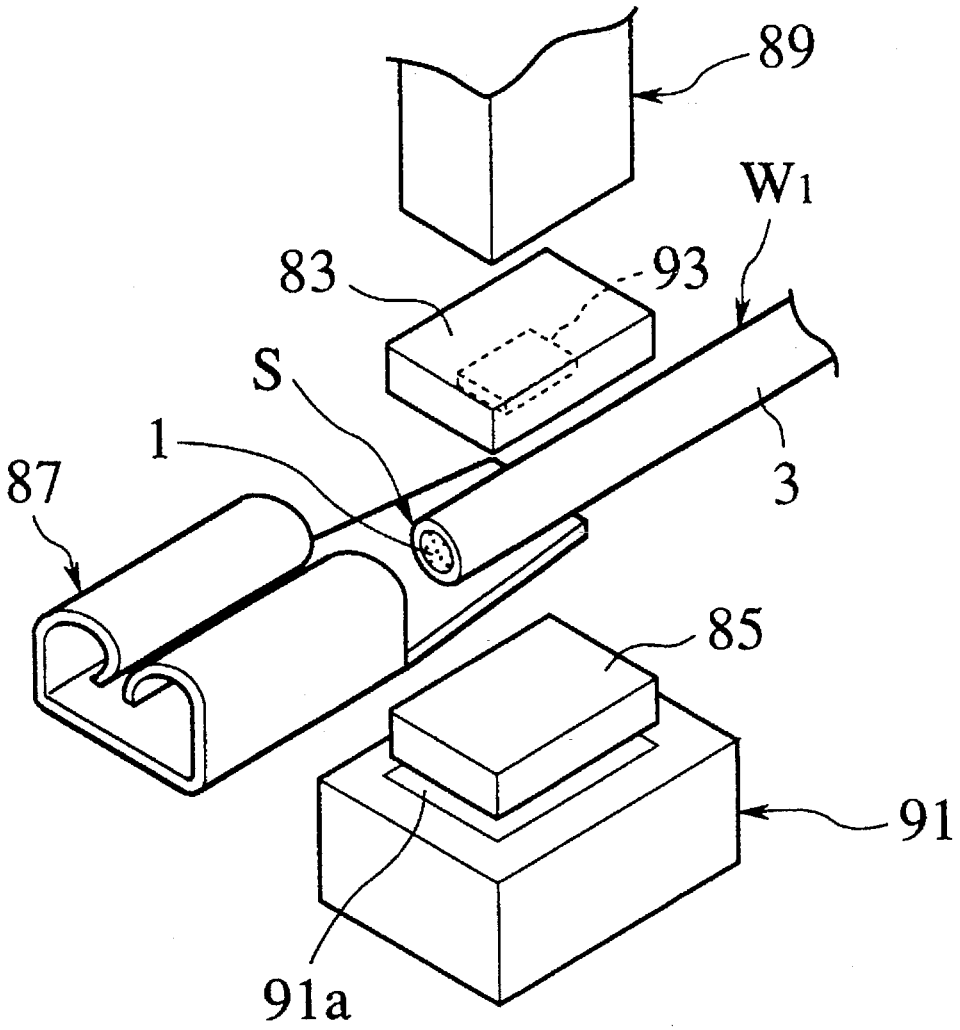
FIG. 24 is a perspective view of the connection system when the fourth or fifth embodiment is applied to a connection mode between a covered wire and a terminal fitting.

FIG. 22 is a perspective view showing a connection system for obtaining a covered wire connection structure of the seventh embodiment, and FIG. 23 is a perspective view showing the connection structure of the seventh embodiment. The same elements as the first embodiment are represented by the same reference numerals, and the duplicate description thereof is omitted.

In the seventh embodiment, the covered wire W1 is conductively connected to a connection portion S of a terminal fitting 87 as shown in 22.

The covered wire connection method according to the seventh embodiment is basically identical to that of the first embodiment. That is, the connection portion S at the end portion of the covered wire W1 is placed on the connection portion S of the terminal fitting 87. Thereafter, the connection portions S of the covered wire W1 and the terminal fitting 87 are pinched by a pair of resin chips 83 and 85 from the upper and lower sides of the connection portions S, and then pressed and excited between a horn 89 and an anvil 91 from the outside of the upper and lower resin chips 83 and 85. Through this operation, the conductive wire portion 1 of the covered wire W1 is exposed at the connection portion S thereof between the resin chips 83 and 85, and conductively contacted with the terminal fitting 87. Thereafter, the upper and lower resin chips 83 and 85 are melted by ultrasonic vibration, and the confronting surfaces of the resin chips 83 and 85 are melt-fixed to each other, so that the conductive wire portion 1 of the covered wire which is conductively contacted with the terminal fitting 87 is covered with the resin chip 83. The resin chips 83 and 85 are designed in a rectangular shape of about 2 to 8 mm in width. A support recess 91*a* for the resin chip 85 is formed on the upper surface of the anvil 91 so as to meet the shape of the resin chip 85.

According to the seventh embodiment, the same effect as the first embodiment can be also obtained when the covered wire W1 is connected to the terminal fitting 87. Furthermore, no crimping work for the terminal fitting 87 is required, and thus the connection work can be facilitated.

The connection method and structure of the fourth and fifth embodiments are applicable to the connection mode between the covered wire W1 and the flat cable 75 (see FIG. 17) and the connection mode between the covered wire W1 and the terminal fitting 87. That is, When the soldering member 93 is provided to the resin chips 53, 55, 83 and 85 in the sixth or seventh embodiment, an effect that a higher mechanical strength can be obtained at the connection portions S can be also obtained in addition to the same effect as the sixth or seventh embodiment. In the case of the connection between the covered wire W1 and the terminal fitting 87, the conductive wire portion 1 of the covered wire W1 and the terminal fitting 87 can be brazed by merely providing the soldering member 93 to only the upper resin chip 83 located at the covered wire W1 side.

In the first to seventh embodiments as described above, the waterproof (water stopping) effect is also obtained when the covered wire is actually connected to a member (another covered wire or the like) to be conductively connected to the covered wire. However, the same waterproof effect can be also obtained by independently subjecting an individual covered wire on the same connection treatment as carried out for the first to seventh embodiments before the covered wire is connected to another member (covered wire) as described below.

The connection method and structure for obtaining the waterproof effect for a covered wire will be next described as an eighth embodiment of the present invention with reference to FIGS. 25 to 30.

The connection (waterproof connection) system of the covered wire is basically identical to that of the first embodiment except that the waterproof connection treatment is conducted on an individual covered wire and the melted resin material is filled in gaps between core wires of the covered wire like the second embodiment. In the second embodiment, the waterproof effect is obtained at the same time when two covered wires are conductively connected to each other. On the other hand, in this embodiment the waterproof effect is obtained when a covered wire is subjected to the waterproof treatment irrespective of after or before the covered wire is connected to another member. The same elements as the first and second embodiments are represented by the same reference numerals.

Figure 25:
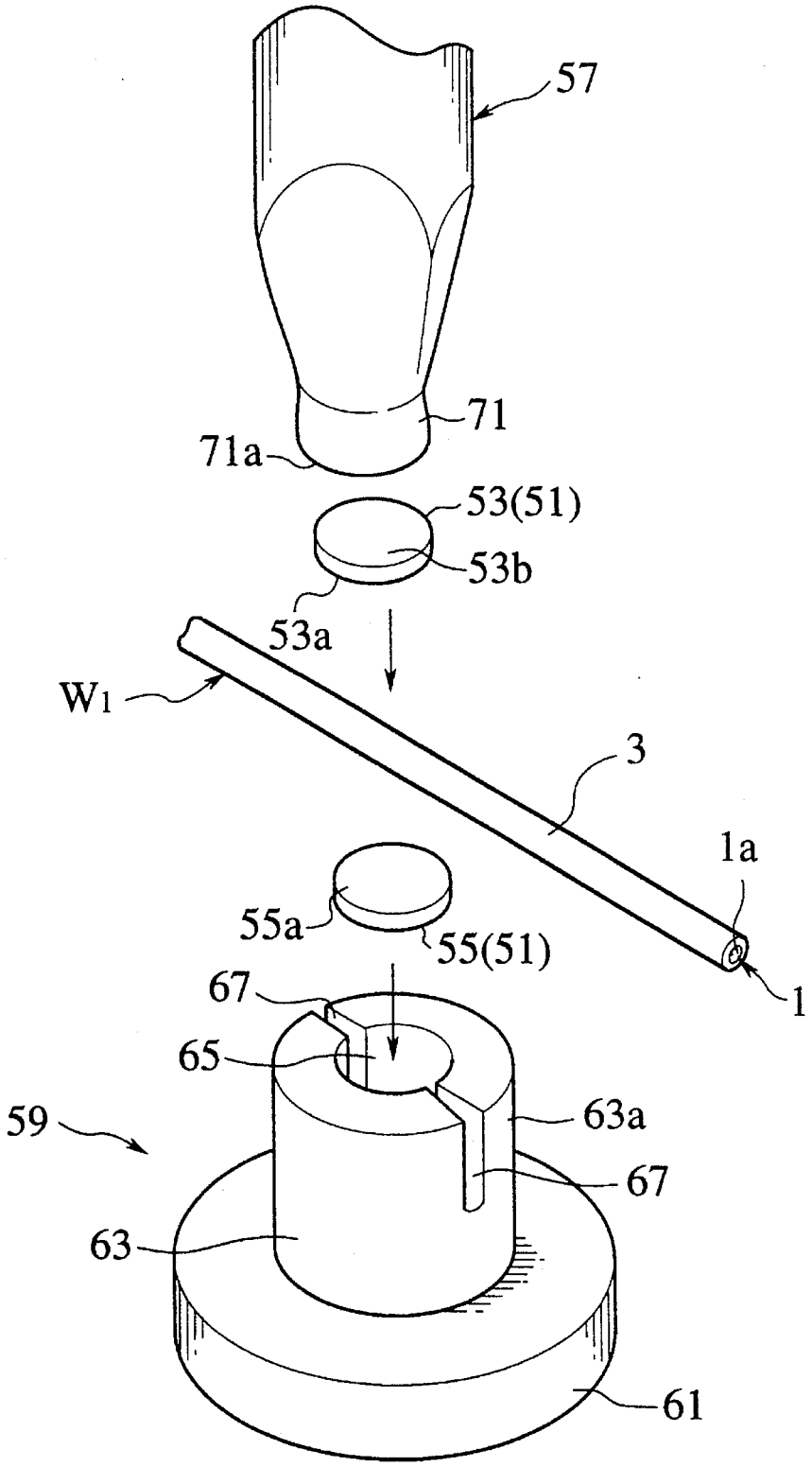
FIG. 25 shows a waterproof connection system for obtaining a waterproof structure of a covered wire according to an eighth embodiment before a waterproof treatment is conducted.
Figure 26:
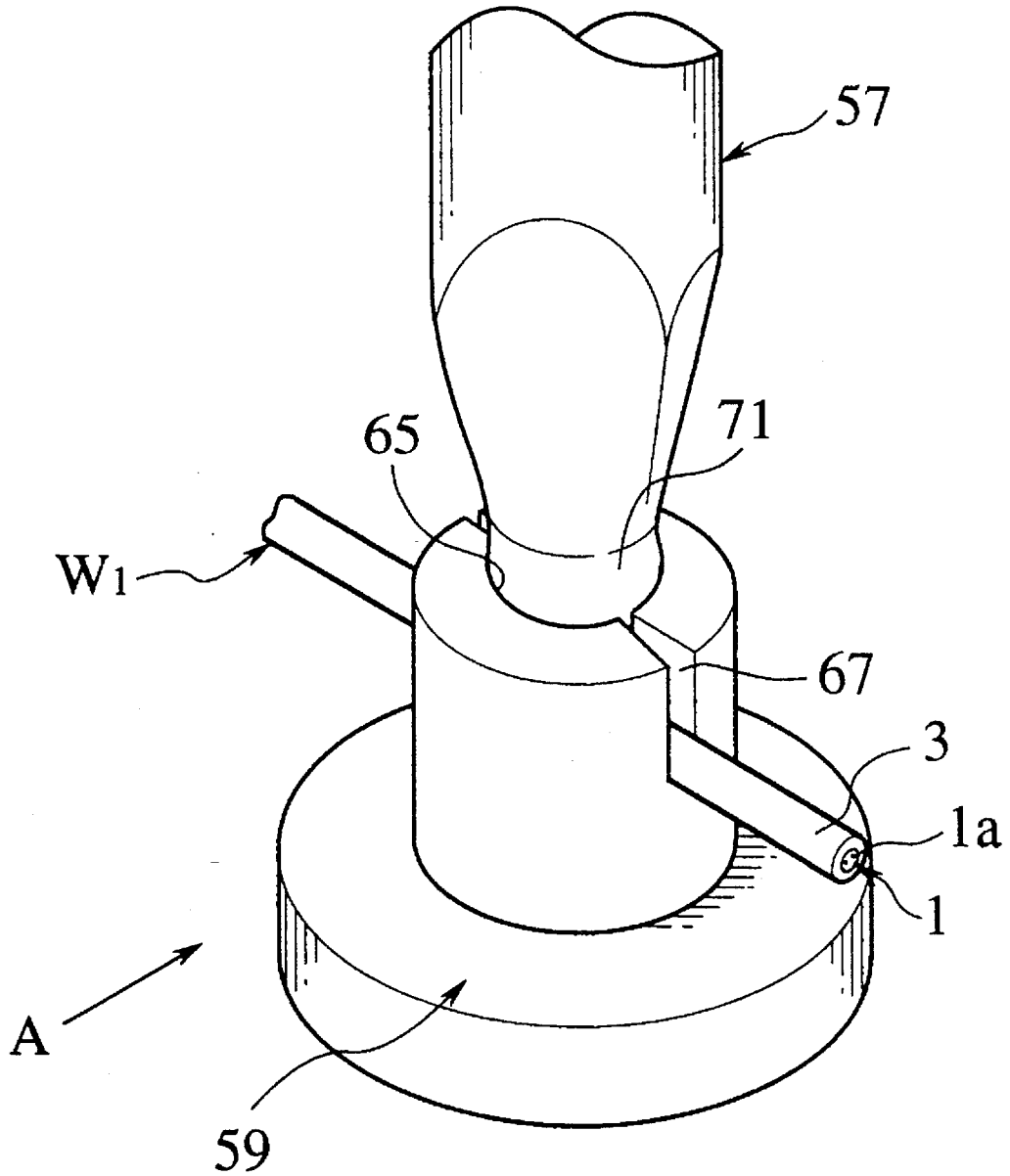
FIG. 26 shows the waterproof connection system of FIG. 25 during the-waterproof treatment.
Figure 27A:
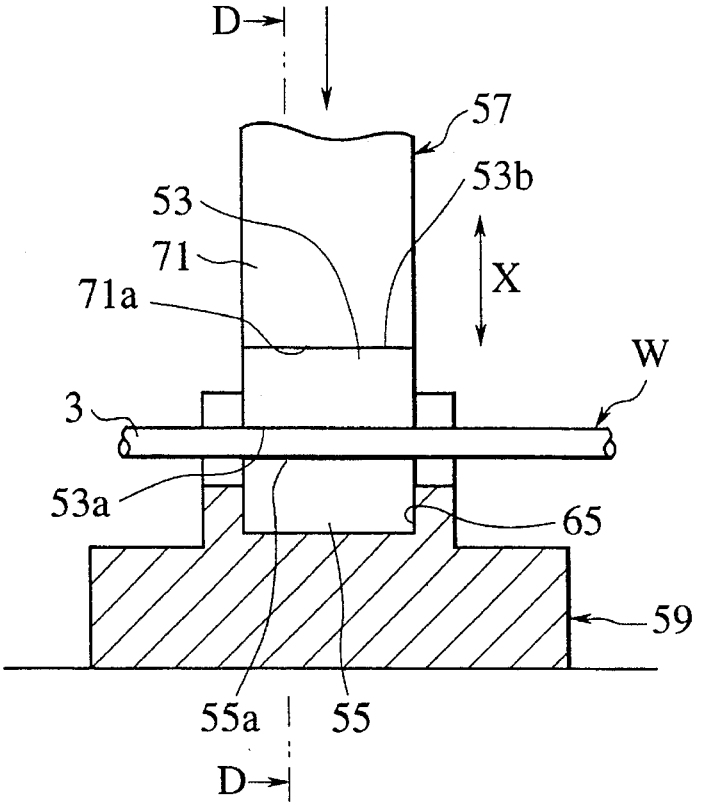
Figure 27B:
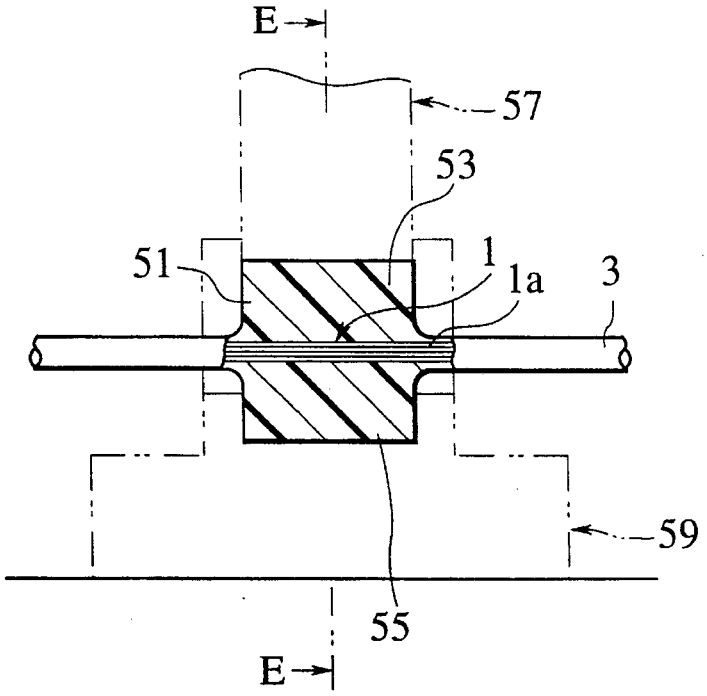
Figure 28:
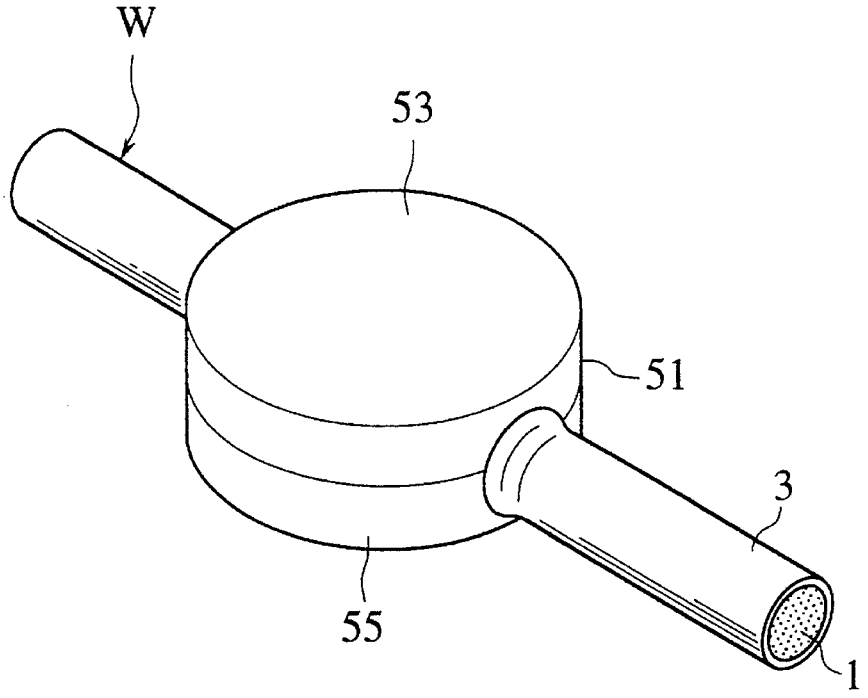
FIG. 28 is a perspective view showing a waterproof structure of the eighth embodiment.

FIGS. 25 and 26 are schematic diagrams showing a waterproof connection system for obtaining the waterproof connection structure of an individual covered wire W1. Particularly, FIG. 25 shows a state of the system before the covered wire is subjected to a waterproof treatment, and FIG. 26 shows a state of the system after the covered wire is subjected to the waterproof treatment. The waterproof treatment of this embodiment is basically identical to the waterproof connection treatment of the second embodiment except that the waterproof treatment is independently conducted to an individual covered wire in the this embodiment whereas the waterproof treatment of the second embodiment is conducted at the same time when the covered wires are connected to each other. FIGS. 27A and 27B are cross-sectional views of the system shown in FIGS. 25 and 26 which are viewed-from an arrow A, respectively. Particularly, FIG. 27A shows a state before the covered wire is subjected to the waterproof treatment, and FIG. 27B shows a state after the covered wire is subjected to the waterproof treatment. FIG. 28 is a perspective view of the waterproof structure of the covered wire.

Next, the waterproof connection method for the covered wire W1 according to the eighth embodiment will be described in detail.

Like the first and second embodiments, for the waterproof connection of a covered wire W are used a pair of resin chips 53 and 55, a horn 57 for producing ultrasonic vibration, and an anvil 59 for supporting the covered wire W and the resin chips 53 and 55. The anvil 59 includes a base stand 61 and a support portion 63 projecting from the base stand 61. The support portion 63 is designed in a substantially cylindrical shape. The support portion 63 has a bore portion 65 which is opened at the opposite side to the base stand side (at the upper side in FIG. 25), and two grooves 67 are formed on the peripheral wall of the support portion 63 so as to confront each other with respect to the center of the bore portion 65, that is, the grooves 67 are aligned straightly to meet the covered wire W. The grooves 67 are formed on the peripheral wall of the support portion 63 so as to be opened at the same side as the bore portion 65, extend along the projection direction of the support portion 63 and intercommunicate with each other through the bore portion 65.

The pair of resin chips 55 and 55 are designed in a disc shape having a slightly smaller outer diameter than the diameter of the bore portion 65 of the anvil 59. Furthermore, the end face 71*a* of the head portion 71 of the horn 57 is designed in a disc shape having an outer diameter which is substantially equal to or slightly smaller than that of the resin chips 53 and 55. As material of the resin chips 53 and 55 may be used acrylic resin, ABS (acrylonitrile-butadiene-styrene copolymer) resin, PC (polycarbonate) resin, PVC (polyvinyl chloride) resin, PE (polyethylene) resin or the like.

In order to perform the waterproof treatment on the covered wire W, the covered wire W is first pinched by the pair of resin chips 53 and 55 from the upper and lower side of the covered wire W.

Specifically, one of the resin chips (the resin chip 55 at the lower side) is inserted into the bore portion 65 of the anvil 59, and then the covered wire W is inserted into the grooves 67 from the upper side of the inserted resin chip 55, so that the covered wire W is placed on the inserted resin chip 55 in the bore portion 65. Thereafter, the other resin chip 53 is inserted into the bore portion 65 and placed on the covered wire W. Accordingly, the covered wire W is disposed in the bore portion 65 so as to be sandwiched between the resin chips 53 and 55 substantially at the center of the bore portion 65.

Subsequently, the cover portion 3 of the covered wire W is melted and dispersed to expose the conductive wire portion 1 of the covered wires W, and the resin chips 53 and 55 are mutually melt-fixed to each other, whereby the melted the resin chips 53 and 55 are filled into the gaps between the core wires of the covered wire W, and the exposed conductive wire portion 1 of the covered wire W is sealed by the resin chips 53 and 55.

Specifically, the head portion 71 of the horn 57 is inserted into the bore portion 65 from the upper side of the finally-inserted upper resin chip 53 and placed on the upper resin chip 53 to press and excite the covered wire W from the outside of the upper and lower resin chips 53 and 55 between the horn 57 and the anvil 59. The press of the covered wire W is performed by pressing the horn 57 toward the anvil 59, and the press direction is coincident with the overlapping direction of the overlapping direction of the resin chips 53 and 55.

When the resin chips 53 and 55 are melt-fixed to each other by the ultrasonic vibration, the excitation is preferably performed in a direction which is substantially perpendicular to the contact surfaces thereof because it provides the most excellent melt-fixing state. Therefore, the direction of the excitation of the covered wire W is set to a direction which crosses the confronting surfaces 53*a* and 55*a* of the resin chips 53 and 55, that is, it is set to be coincident with the vertical direction. With this arrangement, the longitudinal vibration is produced from the horn 57.

When the covered wire W and the resin chips 53 and 55 are pressed and excited in the above state, the cover portion 3 is first melted and the conductive wire portion 1 of the covered wire W is exposed between the resin chips 53 and 55. At this time, the melted cover portion 3 is extruded from the center side of the resin chips 53, 55 toward the outside thereof because the covered wire W is pressed from the upper and lower sides thereof, so that the conductive wire portion 1 is exposed more excellently. Like the press direction, the excitation direction is set to be coincident with the vertical direction of the covered wire, so that the action of extruding the melted cover portion 3 from the center side of the resin chips 53, 55 to the outside thereof is promoted.

When the pressing and exciting operation is further continued after the melting of the cover portion 3, the resin chips 53 and 55 are melted, and the confronting surfaces of the resin chips 53 and 55 (the lower surface 53*a* of the upper resin chip 53 and the upper surface 55*a* of the lower resin chip 55) are melt-fixed to each other. In addition, the outer peripheral surface portion of the cover portion 3 which is adjacent to the exposed conductive wire portion 1 and the resin chips 53 and 55 are melt-fixed to each other. With this operation, the outer peripheral portion of the exposed conductive wire portion 1 are kept to be covered by the resin chips 53 and 55.

Figure 29A:
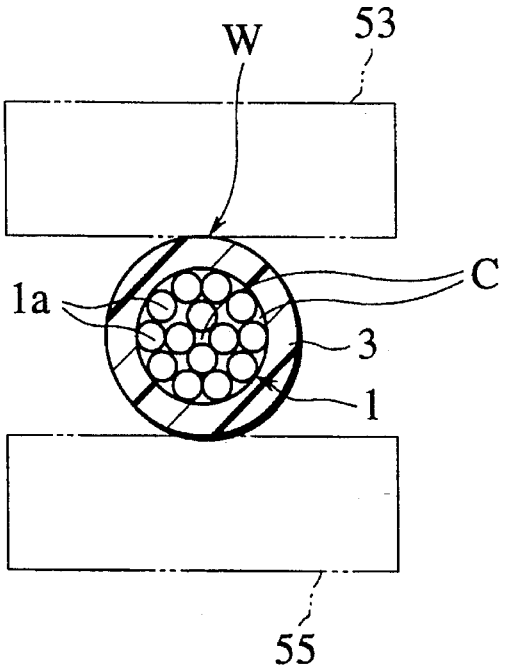
FIG. 29A is a D—D cross-sectional view of FIG. 27A.

On the other hand, the covered wire W includes therein gaps C between the cover portion 3 and a bundle of core wires 1*a* and between the core wires 1*a* before the press and excitation operation as shown in FIG. 29A. When the cover portion 3 is melted and dispersed through the above waterproof treatment, the melted resin chips 53 and 55 are filled into the gap C between the cover portion 3 and the bundle of the core wires 1*a*. Furthermore, by pressing the resin chips 53 and 55 from the upper side thereof, the resin chips 53 and 55 are filled into the gaps between the core wires 1*a* as shown in FIG.. 29B. That is, all the gaps C in the covered wire W are shielded by the resin chips 53 and 55.

After the melting of the resin chips 53 and 55, the pressing and exciting operation of the horn 57 is stopped to harden the melted cover portion 3 and the melted resin chips 53 and 55, and then the connection work is finished.

Next, the covered-wire waterproof structure of the eighth embodiment which is obtained by the waterproof connection method as described above will be described.

Figure 29B:
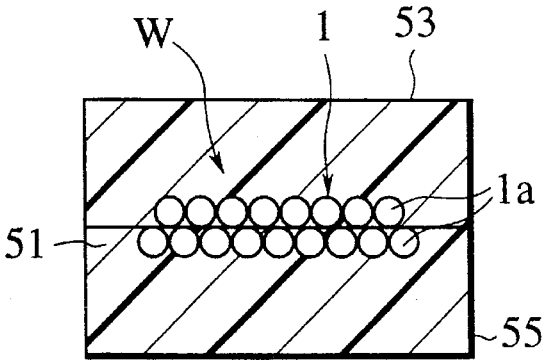
FIG. 29B is an E—E cross-sectional view of FIG. 27B.

In the waterproof structure of this embodiment, the covered wire W is subjected to the waterproof treatment with a pair of resin chips 53 and 55 as shown in FIG. 28, and the resin material 51 is filled in the gaps between the core wires 1*a* of the exposed conductive wire portion 1 as shown in FIG. 29B to seal the exposed conductive wire portion 1 with the resin material 51.

According to the waterproof structure as described above, the gaps C in the covered wire W are kept to be shielded by the resin material 51. Accordingly, even when water flows into the covered wire W from one side of the resin material 51 due to the capillary phenomenon, the water can be prevented from flowing through the covered wire W and passing the other side of the resin material 51, so that the waterproof (water stopping) effect can be obtained in the covered wire W.

Figure 30:
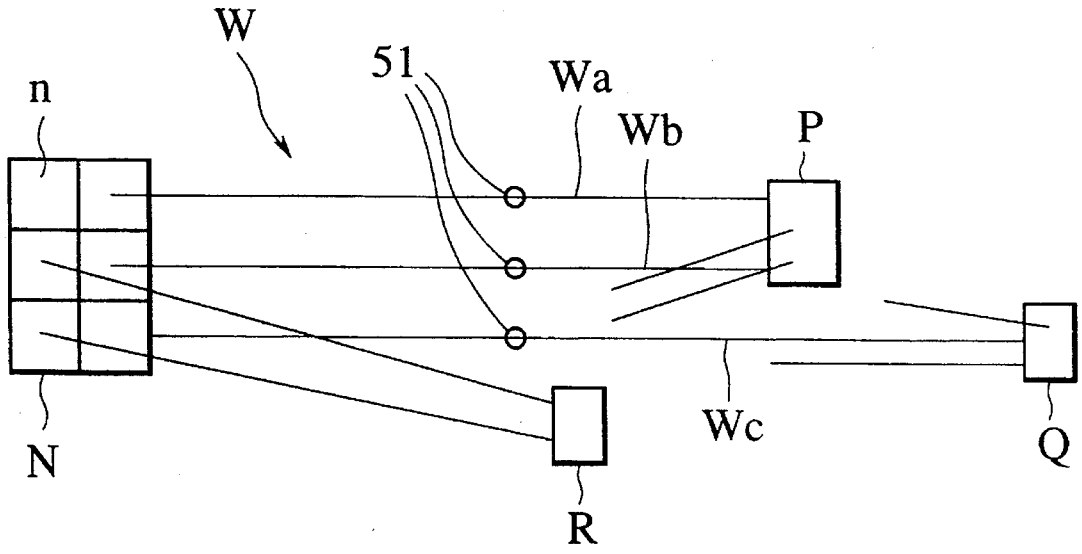
FIG. 30 is a diagram showing a connection system when waterproofed covered wires are used for a connection mode between a multipolar connector and plural connectors.

FIG. 30 shows a connection system when waterproof-treated covered wires are used for a connection between a multipolar connector having some waterproof-required portions and plural connectors which need no waterproof.

In this system, a multipolar connector N is provided with some portions (n) which functionally need waterproof (hereinafter referred to as "waterproof portions"), and the multipolar connector N is connected through covered wires W (Wa, Wb and Wc) to connectors P and Q which functionally requires no waterproof treatment and to a connector R which functionally requires the waterproof treatment. In this case, the waterproof treatment as described above is conducted on the covered wires Wa, Wb and Wc through which the connectors P and Q are connected to the multipolar connector N. Therefore, even when water flows into the covered wires W from the connectors P and Q, 5 the water can be surely prevented from flowing out into the connector N. Accordingly, the waterproof property can be kept for the waterproof portions of the multipolar connector N without conducting the waterproof treatment on the connectors P and Q (i.e., with the connectors P and Q left simple in structure). Therefore, the manufacturing cost can be reduced.

According to this embodiment, the waterproof effect can be obtained for an individual covered wire by such a simple method of dispersively melting the cover portion 3 of the covered wire W while pressing the covered wire W from the outside of the resin chips 53 and 55 in the state where the covered wire W is pinched by the resin chips 53 and 55, and then melt-fixing the resin chips 53 and 55 to each other. Accordingly, when a covered wire W whose one end side is connected to a waterproof-required member is connected at the other end side thereof to a member which functionally requires no waterproof, by merely subjecting the covered wire W to the waterproof treatment with the resin material 51, the waterproof property can be kept for the one end side of the covered wire without conducting the waterproof treatment on the other side of the covered wire W.

Furthermore, the resin chips 53 and 55 may be designed in such compact size and shape as to pinch the covered wire W from the upper and lower sides thereof, and thus an area required for the waterproof treatment can be reduced.

The waterproof method as described above is a relatively simple method that the covered wire W is pinched by the resin chips 53 and 55, and then pressed and excited between the horn 57 and the anvil 59 from the outside of the resin chips 53 and 55, and no limitation in shape, etc. is imposed on the covered wire. Therefore, the waterproof method and structure of this embodiment can be easily applied to various types of covered wires W, and thus its practical use can be widened. 5 Furthermore, the covered wire W is pinched by the resin chips 53 and 55 from the upper and lower sides thereof and then pressed and excited between the horn 57 and the anvil 59 from the outside of the resin chips 53 and 55, and the press direction is set to be coincident with the vertical direction to the covered wire W. Therefore, at the press time of the covered wire W, the melted cover portion 3 is extruded from the center side of the resin chips 53 and 55 to the outside thereof, and thus the conductive wire portion 1 is exposed excellently. In addition, the excitation direction is also coincident with the vertical direction like the press direction, so that the excellent melt-fixing state of the resin chips can be obtained, and the action of extruding the cover portion 3 can be promoted. Accordingly, the waterproof effect and sealing effect of the resin chips can be more surely obtained.

When the resin material 51 is formed of transparent material, in addition to the effect of the eighth embodiment, the fill-in state of the resin chips 53 and 55 can be viewed from the outside. Therefore, the facilitation of the quality management and the improvement in quality can be performed.

Next, a ninth embodiment of the present invention will be described with reference to FIGS. 31 to 33. In this embodiment, the waterproof treatment is conducted to a conductive wire portion of a flat cable which comprises a sheet-shaped cover portion 73 of resin, and plural conductive wire portions 1 which are juxtaposed in the cover portion 73. In this case, the flat cable serves as a covered wire W in the eighth embodiment.

Figure 31:
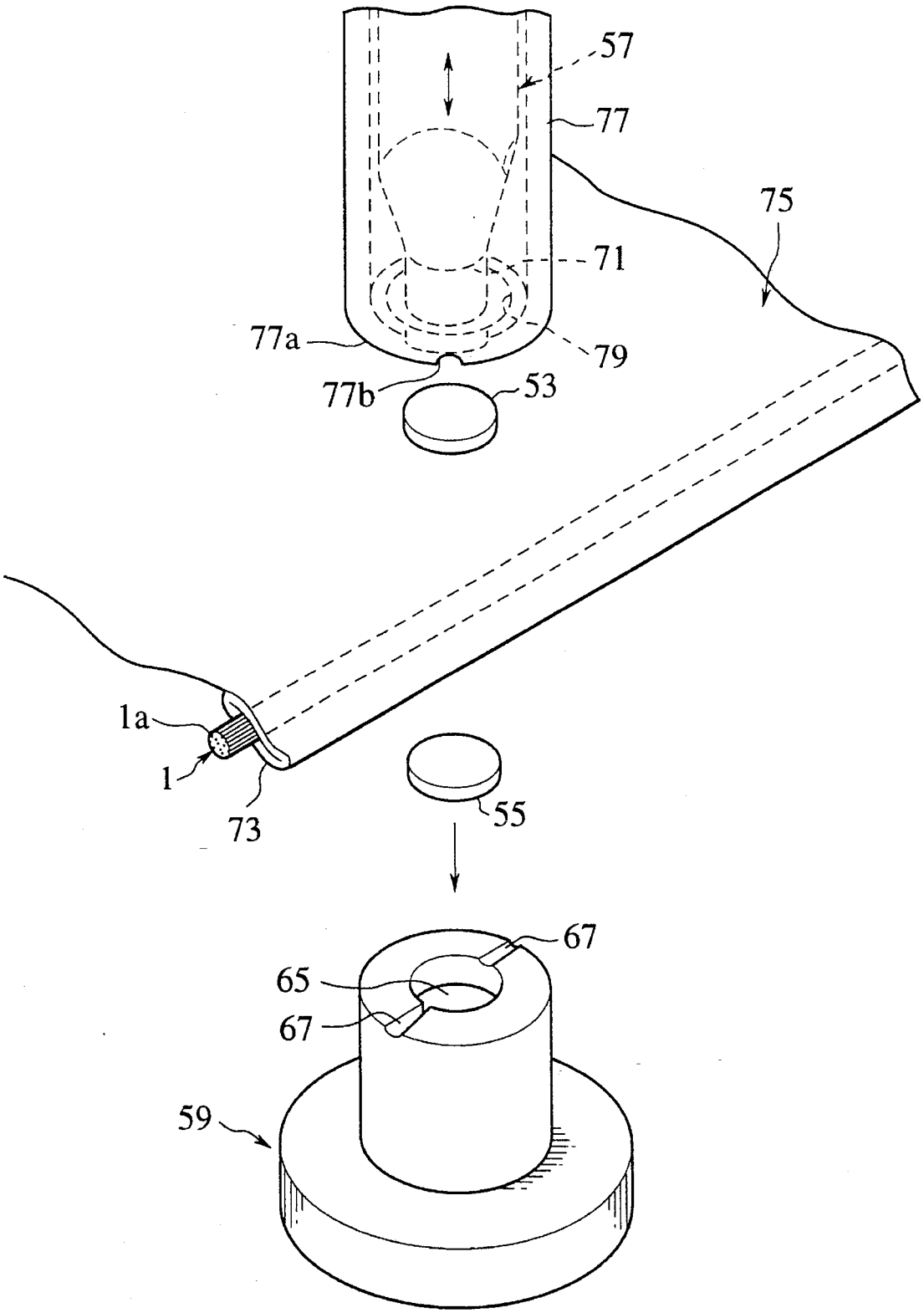
FIG. 31 is a perspective view showing a waterproof connection system for obtaining a waterproof structure of a ninth embodiment before the waterproof treatment is conducted.
Figure 32:
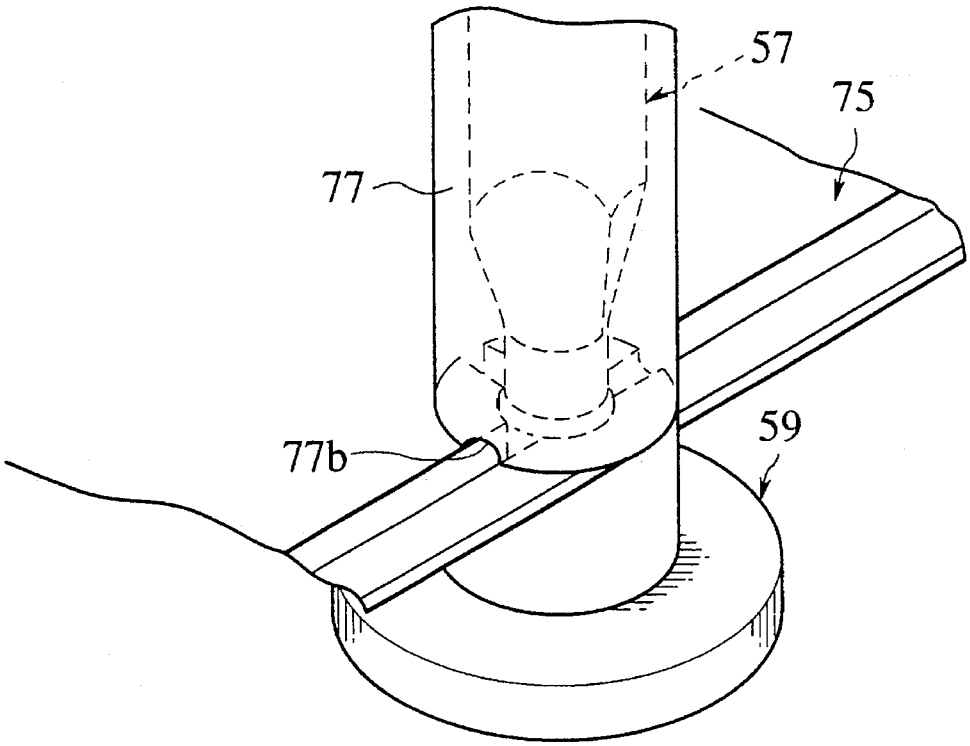
FIG. 32 is a perspective view showing the waterproof connection system of FIG. 31 during the waterproof treatment.
Figure 33:
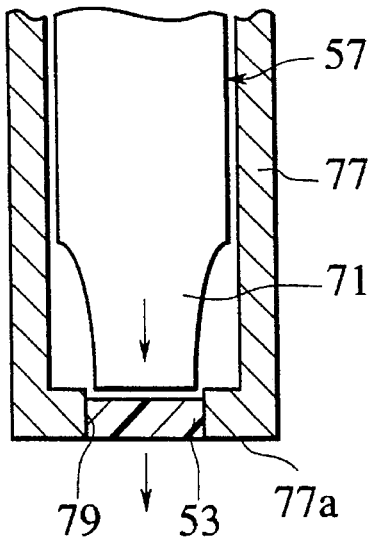
FIG. 33 is a cross-sectional view of a horn used in the ninth embodiment.

FIG. 31 shows a state before the waterproof treatment is conducted, FIG. 32 shows a state during the waterproof treatment. and FIG. 33 is a cross-sectional view of the horn shown in FIG. 32.

The waterproof treatment of the ninth embodiment is substantially identical to that of the eighth embodiment. That is, the lower resin chip 55 is inserted into the bore portion 65 of the anvil 59, and then a conductive wire portion 1 in the cover portion 73 of the flat cable 75 is inserted into the grooves 67 and placed on the lower resin chip 55. In this case, the conductive wire portion 1 cannot be perfectly inserted into the groove portions 67 because the cover portion 73 is designed in a sheet shape, and thus the flat cable 75 is merely mounted on the anvil 59 as shown in FIG. 32. In order to meet this arrangement, the bore portion 65 and the groove portions 67 are designed to be shallow. Furthermore, when the upper resin chip 53 is put on the flat cable 75 mounted on the anvil 59, the resin chip 53 is merely mounted on the flat cable 75, and thus a positioning work for the resin chip 53 and the press and excitation operation are difficult to be carried out. In order to overcome this disadvantage, a cylindrical chip holder 77 is provided at the outside of the horn 57 as shown in FIG. 33. The lower end 77*a* of the chip holder 77 is provided with an opening portion 79 through which the head portion 71 of the horn 57 is passed and in which the upper resin chip 53 is temporarily held. Accordingly, as shown in FIG. 33, the lower end 77*a* of the chip holder 77 is erectly set on the flat cable 75 so as to meet the bore portion 65 of the anvil 59 while the upper resin chip 53 is temporarily held at the opening portion 79, and the horn 57 is pressed to extrude the temporarily-held upper resin chip 53 downwardly, whereby the conductive wire portion 1 of the flat cable 75 is pinched by the resin chips 53 and 55 from the upper and lower sides thereof. Furthermore, groove portions 77*b* which have the arcuate shape in section and are engageable with the conductive wire portion 1 of the flat cable 75 from the outside of the cover portion 73 are formed at the lower end of the chip holder 77, and the positioning of the upper resin chip 53 when the chip holder 77 is erectly set on the flat cable 75 can be easily performed with these groove portions 77*b*. The subsequent waterproof steps are identical to those of the eighth embodiment.The waterproof structure of the covered wire of this embodiment is substantially identical to that of the eighth embodiment. That is, the cover portion 73 is dispersively melted in the resin material 51 comprising a pair of resin chips 53 and 55, and the conductive wire portion 1 of the flat cable 75 is exposed. The resin material 51 is filled into the gaps between the core wires 1*a* of the exposed conductive wire portion 1, and the exposed conductive wire portion 1 is sealed by the resin material 51.

As described above, according to the ninth embodiment, the same waterproof effect as the eighth embodiment can be obtained for the flat cable 75.

Furthermore, when the resin material 51 is formed of transparent material, the contact state of the conductive wire portion 1 with the resin chips can be viewed from the outside thereof.

As described above, according to the covered-wire connection method of the first aspect of the present invention, it is unnecessary to beforehand remove the cover portion, and the connection work can be easily performed. In addition, the high mechanical strength and sufficient insulation can be obtained at the connection portions by the hardened chips, so that the conductivity characteristic can be stabilized, and the practical use can be widened.

According to the first aspect of the present invention, in addition to the effect as described above, the waterproof (water stopping) effect can be obtained in the covered wire. Accordingly, for example in a case where one end side of a covered wire is connected to a waterproof-required member and the other end side of the covered wire is connected to a member needing no waterproof, even when water invades into the covered wire from the member connected to the other end side of the covered wire due to the capillary phenomenon, the water can be prevented from flowing out to the one end of the covered wire by the waterproof effect of the covered wire. Accordingly, the waterproof property can be kept for the waterproof-required member by the low-cost method without conducting the waterproof treatment on the member which needs no waterproof.

According to the first aspect of the present invention, in addition to the effects as described above, the higher electrical performance can be obtained at the connection portions by the simple method of using the resin chips provided with the brazing material, and the conductivity characteristic can be more stabilized.

According to the first aspect of the present invention, in addition to the effects as described above, the brazing material is melted out in the resin chips after the connection portions are covered by the resin chips, so that the conductively contacted conductive wire connection portions can be surely brazed and the brazing material can be surely prevented from leaking from the resin chips. Therefore, the connection state and the connection workability can be improved.

According to the first aspect of the present invention, in addition to the effects as described above, the conductive wire portions are excellently exposed at the connection portions and the conductive contact state of the connection portions can be surely obtained. In addition, a good melt-fixing state can be obtained for the resin chips.

According to the first aspect of the present invention, in addition to the effects as described above, the conductive wire portion is excellently exposed at the connection portion and the conductive contact state can be surely obtained. In addition, the resin chips are excellently melt-fixed to each other, and the metallic joint is obtained in a broad area at the connection portion. Accordingly, even when the covered wire is used under a severe condition, the conductivity characteristic at the connection portion can be kept excellent. Since the metallic joint area is broaden at the connection portion, the heat occurring when current is supplied to the covered wire can be reduced, and thus the same effect as obtained when resin material having excellent heat resistance can be obtained with resin material of relatively low price.

According to the covered-wire connection structure of the second aspect of the present invention, the high mechanical strength and the sufficient insulation can be obtained at the connection portion with the hardened resin, so that the conductivity characteristic can be stabilized and the practical use can be widened.

According to the second aspect of the present invention, in addition to the effect as described above, the waterproof effect can be obtained in the covered wire. Accordingly, for example in a case where one end side of a covered wire is connected to a waterproof-required member and the other end side of the covered wire is connected to a member needing no waterproof, even when water invades into the covered wire from the member connected to the other end side of the covered wire due to the capillary phenomenon, the water can be prevented from flowing out to the one end of the covered wire by the waterproof effect of the covered wire. Accordingly, the waterproof property can be kept for the waterproof-required member by the low-cost method without conducting the waterproof treatment on the member which needs no waterproof.

According to the second aspect of the present invention, in addition to the effects as described above, the higher electrical performance can be obtained at the connection portion by the brazing of the resin material, and thus the conductivity characteristic can be more stabilized.

According to the second aspect of the present invention, in addition to the effects as described above, the conductive contact state of the conductive wire portion can be viewed from the outside of the resin material, so that the facilitation of the quality management and the improvement of quality can be performed.

According to the second aspect of the present invention, the effects as described above can be also obtained when the flat cable is conductively connected to another member.

According to the covered-wire waterproof connection method and structure of the third and fourth aspects of the present invention, the waterproof effect can be independently obtained in an individual covered wire by a simple work or a simple structure. Accordingly, for example in a case where one end side of a covered wire is connected to a waterproof-required member and the other end side of the covered wire is connected to a member needing no waterproof, even when water invades into the covered wire from the member connected to the other end side of the covered wire due to the capillary phenomenon, the water can be prevented from flowing out to the one end of the covered wire by the waterproof effect of the covered wire. Accordingly, the waterproof property can be kept for the waterproof-required member by the low-cost method without conducting the waterproof treatment on the member which needs no waterproof. Furthermore, the area to be subjected to the waterproof treatment can be reduced, and no limitation in shape is imposed on the covered wire, so that the practical use can be widened.

According to the third and fourth aspects of the present invention, in addition to the effect as described above, the conductive wire portion of the covered wire is excellently exposed at the press time of the covered wire, and thus the waterproof effect and the sealing effect can be surely obtained.

According to the third and fourth aspects of the present invention, in addition to the effects as described above, the fill-in state of the resin material can be viewed from the outside, and the facilitation of the quality management and the improvement of quality can be achieved.

According to the third and fourth aspects of the present invention, the same effects as described above can be obtained for a flat cable, and the practical use can be further widened.

What is claimed is:

1. A covered wire connection method for conductively connecting members at least one of which is a covered wire having a conductive wire portion and a cover portion formed by coating resin around an outer periphery of the conductive wire portion, said method comprising:

a first step of overlapping said members with each other and pinching an overlapping portion of said members between a pair of resin chips; and a second step of pressurizing and exciting said overlapping portion pinched by said resin chips using an ultrasonic vibration welding apparatus so as to melt and disperse said cover portion, thereby to expose the conductive wire portion and electrically conductively connect the conductively wire portions of said members at said overlapping portion and so as to melt-fix said pair of resin chips to seal the connected overlapping protion of said members with said melted resin chips.

2. A covered wire connection method as claimed in claim 1, wherein said wire portion is constituted by plural wire cores and said second step further comprises:

filling the melted resin chips into gaps between said plural wire cores except a said overlapping portion of said members while melting said pair of resin chips.

3. A covered wire connection method as claimed in claim 1, wherein at least one of said resin chips is provided with brazing material and said second step further comprises:

brazing said conductive wire portion at said overlapping portion with said brazing material when said resin chips are melted.

4. A covered wire connection method as claimed in claim 3, wherein said brazing material is buried in at least one of said resin chips.

5. A covered wire connection method as claimed in claim 1, wherein:

said first step comprises pinching said members between said pair of resin chips in an overlapping direction of the members, and said second step comprises pressurizing and exciting the overlapping portion in said overlapping direction.

6. A covered wire connection method as claimed in claim 1, wherein:

said first step comprises pinching said members between said pair of resin chips in an overlapping direction of the members, and said second step comprises pressurizing the overlapping portion in said overlapping direction and exciting the overlapping portion in both said overlapping direction and a direction perpendicular to said overlapping direction.

7. A waterproof treatment connection method for a covered wire having a conductive wire portion constituted by plural wire cores and a cover portion formed by coating resin around an outer periphery of the conductive wire portion, said method comprising:

a first step of pinching a portion of said covered wire between a pair of resin chips;

a second step of pressurizing and exciting said pinched portion of said covered wire through said resin chips using an ultrasonic vibration welding apparatus so as to melt and disperse said cover portion thereby to expose said plural wire cores and to melt-fix said pair of resin chips to fill melted resin chips into gaps between the exposed plural wire cores while melting said pair of resin chips.

* * * * *